US012433357B1

(12) United States Patent
Lape Clagett et al.

(10) Patent No.: US 12,433,357 B1
(45) Date of Patent: Oct. 7, 2025

(54) REUSABLE, REAR-OPENING PROTECTIVE GARMENT WITH FASTENING ELEMENTS CONFIGURED TO FACILITATE DOFFING-TYPE REMOVAL

(71) Applicant: Standard Textile Co., Inc., Cincinnati, OH (US)

(72) Inventors: Jessica Lauren Lape Clagett, Cincinnati, OH (US); Richard Holbert, Jr., Loveland, OH (US); Rajib Mondal, Gulf Breeze, FL (US); Sara Arvidson Broadaway, Woodruff, SC (US); Warren William Gerhardt, Spartanburg, SC (US); Amy M. Luttrell, Cincinnati, OH (US); Veronica L. Eastman, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 0 days.

(21) Appl. No.: 18/763,712

(22) Filed: Jul. 3, 2024

(51) Int. Cl.
*A41D 13/12* (2006.01)

(52) U.S. Cl.
CPC ..... *A41D 13/1209* (2013.01); *A41D 13/129* (2013.01)

(58) Field of Classification Search
CPC . A41D 13/12; A41D 13/1209; A41D 13/1236
See application file for complete search history.

(56) References Cited

U.S. PATENT DOCUMENTS 1,582,385 A * 4/1926 Dauphinais ..... A41D 10/00 2/114
3,372,438 A 3/1968 Rinecker
3,790,964 A * 2/1974 Hartigan ..... A41D 13/1209 340/471

(Continued)

FOREIGN PATENT DOCUMENTS

CA 2348347 A1 * 12/2001 ..... A41D 13/1209
JP 5399028 B2 1/2014

(Continued)

OTHER PUBLICATIONS

"Tapey Snapper." Morito. Dec. 8, 2016. https://www.morito.co.jp/product/en/images/03_Tapey_Snapper.pdf (Year: 2016).*

*Primary Examiner* — Grace Huang
(74) *Attorney, Agent, or Firm* — Wood Herron & Evans LLP

(57) ABSTRACT

A rear-opening protective gown configured for removal by pull-forward doffing action is provided. The gown includes a central gown body including a front panel and a back panel. The gown opens at the back panel. A plurality of fastening elements is positioned on or proximate to the back panel. At least one of the fastening elements is located at the shoulder region. For each of the fastening elements that is located at the shoulder region, one of the first and second fasteners is mounted on a folded tab connected to the corresponding portion of the back panel. When a doffing force is applied to the gown, the folded tab rotates to transfer a shearing force into a peeling force thereby facilitating ease of doffing the gown without causing damage to the gown, (Continued)

thereby allowing for reuse. A method of wearing a rear-opening protective gown is also provided.

30 Claims, 16 Drawing Sheets

(56) References Cited

U.S. PATENT DOCUMENTS

| | | | | |
|---|---|---|---|---|
| 4,106,120 | A * | 8/1978 | Zurbrigg | A41D 13/1209 2/913 |
| 4,290,148 | A | 9/1981 | Roberts | |
| 6,134,715 | A * | 10/2000 | McLennan | A41D 13/1245 2/105 |
| 6,983,517 | B2 | 1/2006 | Golden et al. | |
| 7,752,680 | B2 | 7/2010 | Bushman | |
| 7,827,619 | B1 * | 11/2010 | Steinberg | A41D 11/00 2/114 |
| 8,141,172 | B2 | 3/2012 | Furlong | |
| 9,248,322 | B2 | 2/2016 | Yadav et al. | |
| D878,967 | S | 3/2020 | Miyoshi | |
| 10,772,369 | B2 | 9/2020 | Horton | |
| 11,166,500 | B2 | 11/2021 | Stewart et al. | |
| 12,075,865 | B2 * | 9/2024 | Jefferis | A41F 9/025 |
| 2005/0044608 | A1 | 3/2005 | Ambrose et al. | |
| 2008/0000006 | A1 * | 1/2008 | Ochoa | A41D 13/1236 2/114 |
| 2014/0020151 | A1 * | 1/2014 | Czajka | G09F 3/00 2/114 |
| 2015/0150316 | A1 * | 6/2015 | Champagne | A41D 13/129 2/48 |
| 2015/0297938 | A1 * | 10/2015 | Dyer | A63B 21/00185 2/243.1 |
| 2015/0374048 | A1 | 12/2015 | Theodossiou | |
| 2017/0325523 | A1 | 11/2017 | Stewart et al. | |
| 2018/0153239 | A1 | 6/2018 | Horton | |
| 2021/0059323 | A1 * | 3/2021 | Taylor | A41D 27/20 |
| 2022/0205170 | A1 | 6/2022 | Stewart et al. | |
| 2023/0402170 | A1 * | 12/2023 | Ho | G06K 19/0702 |
| 2024/0285003 | A1 * | 8/2024 | Miremadi | A41D 13/1209 |

FOREIGN PATENT DOCUMENTS

| | | | | |
|---|---|---|---|---|
| JP | 2014201839 | A | 10/2014 | |
| JP | 6823405 | B2 | 2/2021 | |
| WO | WO-0033685 | A1 * | 6/2000 | A41D 13/12 |
| WO | WO-2005120263 | A1 * | 12/2005 | A41D 13/1209 |

* cited by examiner

REUSABLE, REAR-OPENING PROTECTIVE GARMENT WITH FASTENING ELEMENTS CONFIGURED TO FACILITATE DOFFING-TYPE REMOVAL

TECHNICAL FIELD

The present invention relates generally to personal protective equipment (PPE) apparel, and more specifically, PPE healthcare apparel in the form of a rear-opening protective gown that may be used by various workers in the healthcare industry, including during surgery.

BACKGROUND

Protective gowns (also referred to as an isolation gown, a surgical gown, or a barrier gown herein) are identified as the second-most used piece of PPE, following gloves, in the healthcare setting. The protective gown is intended to protect healthcare patients and workers (e.g., doctors and nurses) from the transfer of potentially harmful microorganisms, body fluids, and/or particulate materials. The gown generally covers the torso and clothing of a wearer and acts as a physical barrier against the transfer of such microorganisms and other materials.

Protective gowns should facilitate easy donning and doffing (removal) without self-contamination (e.g., by the wearer). The protective gown also should not restrict the movement of the body and should be breathable and comfortable to wear. Many different types of protective gowns are currently available to healthcare workers with varying protection levels. Most of the protective gowns in the market are of a rear opening style, which is a preferred design to assure that a wearer is isolated from any pathological contaminants that may be encountered in the environment during work in surgery or the like. Many of these rear-opening styles are disposable and, thus, generally designed for a single-use.

Certain disposable/single-use gowns utilize a system of closures (or fasteners) including backside neck and/or waist ties, which are designed to simplify donning of the gown and help provide "full body" protection for the wearer. And for doffing, such protective gowns are commonly removed via a "pull forward" method, whereby the wearer (or another individual) grabs the front of the gown (or another portion of the gown) and pulls forcefully forward or away from the wearer's body until, for example, the gown fabric tears completely away from the tie closure(s) or vice-versa. To that end, the gown fabric and/or the tie itself is formed of such a material that it can be broken away or torn apart from the other if sufficient force is exerted during the pull forward method so as to allow the wearer to effectively doff the gown. Though not originally designed for such doffing action by tear away, the convenience and rapid nature of such gown removal in this manner has led the field of PPE wearers to generally doff such garments in this fashion. In other words, this has become the expected norm. This doffing method eliminates the need to actively undo/untie any backside closure(s) (by the wearer or by another—a nurse, for example), and eliminates an opportunity for the wearer to touch their hair or neck with potentially contaminated gloves, thereby providing for safer removal of the gown after use. Although providing a certain level of convenience, disposable tearaway protective gowns may tear at inopportune times, can be viewed as environmentally unfriendly and, in the long run, may be more costly than protective gowns that are designed for reuse/multi-use.

As an alternative to the disposable rear opening gown, the marketplace also offers rear opening gown options that are designed for multi-use and which must be subjected to regular commercial laundering as a result. These types of gowns also generally utilize a system of fasteners, including backside neck and/or waist ties, which also are designed to simplify donning of the gown and help provide "full body" protection for the wearer. However, unlike disposable gowns, the pull forward method of removal has not previously been an option for gowns intended for reuse/multiple use. Notably, the fabric of the gown and the fasteners conventionally employed at the neck and/or waist for reusable rear opening gowns are not at all intended or designed to be easily broken apart/damaged, as such must be designed to survive multiple commercial laundering, sterilization, and duty/use cycles. Indeed, the steadfastness of the fasteners and hardiness of the gown fabric of reusable gowns prohibits the use of the pull forward doffing method, which would negatively impact the reusable life of the gown, such as by rendering the gown unsafe and ineffective for additional uses, and is completely contrary to its intended reusability.

Accordingly, the intended reusability of the gowns for subsequent safe and effective reuse necessitates that the reusable gown be doffed (by the wearer or by another) without being damaged. At present, that requires wearers to reach behind and actively undo/untie any backside fasteners. However, as indicated above, backside untying/undoing, for example, can significantly increase the likelihood of harmful microorganisms and other materials contacting the neck or hair on the head or neck of a wearer, which can be unsafe and is highly undesirable. Moreover, these additional steps are viewed in the PPE wearer community as tedious and undesirable due to the added complication and delay, aside from the potential increased risk factors noted above.

It would therefore be desirable to provide an improved PPE rear opening protective gown, such as for use in the healthcare industry, that is reusable and which can provide for ease of doffing (either by the wearer or by another), such as in a pull forward manner that is consistent with how current users of disposable protective gowns are accustomed to removing such gowns. It would further be desirable that such pull forward doffing be performed without substantial risk of damaging (e.g., tearing) the gown and without substantial risk of the transfer of potentially harmful microorganisms, body fluids, and/or particulate material, to the neck or hair on the head or neck of a wearer.

SUMMARY

The embodiments of the present invention provide rear-opening protective gowns and methods of use that address these and other drawbacks in the known PPE art. Certain exemplary aspects of the invention are set forth below. It should be understood that these aspects are presented merely to provide the reader with a brief summary of certain forms the invention might take and that these aspects are not intended to limit the scope of the invention.

In a first aspect of the invention, a rear-opening protective gown defining a personal protective equipment garment configured for removal by pull-forward doffing action is disclosed. The protective gown includes a central gown body sized to wrap around at least a torso area of a wearer. The central gown body includes a front panel and a back panel, with the back panel being separated into a right portion and a left portion such that the protective gown opens at the back panel. One of the right portion and left portion includes an overlapping section and the other of the right portion and left portion includes a corresponding overlapped section. The overlapping section and overlapped section are configured to lay over one another when the protective gown is donned by the wearer and closed. The protective gown further includes a pair of opposing left and right sleeves that cooperate with and extend away from the central gown body for receiving arms of the wearer. The protective gown also includes a neck opening defined by the central gown body adjacent a shoulder region of the central gown body located proximate a junction of the left and right sleeves with the central gown body. The protective gown also includes a plurality of fastening elements positioned on or proximate to the back panel. Each fastening element includes a first fastener mounted on the overlapping section of the back panel and a second fastener mounted on the overlapped section of the back panel of the central gown body. The first and second fasteners are configured to engage with one another to define a connection having a shear strength greater than a peel strength thereof, with at least one of the fastening elements being located at the shoulder region. For each of the fastening elements that is located at the shoulder region, one of the first and second fasteners is mounted on a folded tab connected to the corresponding portion of the back panel. The folded tab is pivotable relative to the corresponding portion of the back panel such that when a doffing force is applied by the wearer (or by another) to the protective gown, the folded tab rotates to transfer a shearing force to the first and second fasteners, which is generated by transmission of the doffing force through the central gown body, into a peeling force that peels the first fastener apart from the second fastener. This configuration of the fastening elements and the protective gown facilitates ease of doffing the protective gown by application of the doffing force on the front panel without causing damage to the protective gown, thereby allowing for reuse of the protective gown through multiple laundering, sterilization, and duty cycles. The protective gown therefore improves the existing field of protective gowns by combining the pull forward doffing capability with the reusable aspects of the prior, limited gowns.

In one embodiment, each of the fastening elements may be configured to enable the first fastener to releasably engage with the second fastener in various relative positions and orientations such that the connection defined at each fastening element is repositionable and adjustable, while still enabling the transfer from shearing force to peeling force at the fastening elements. Further, for at least some of the fastening elements, one of the first and second fasteners that is not mounted on a folded tab may be formed with an elongated width that is greater than a width of the other of the first and second fasteners, thereby to enable adjustable tightness of closing of the protective gown by engaging the first and second fasteners at different positions and orientations along the elongated width. Additionally, a material defining the front panel of the central gown body and the left and right sleeves may be configured to meet barrier and strength performance metrics defined under ANSI/AAMI PB70:2012 and under ASTM F2407-20, thereby avoiding transmission of microorganisms, bodily fluids, or other contaminants through the protective gown.

In another embodiment, each of the first and second fasteners may be defined by an array of rigid plastic posts extruded upwardly through a textile backing layer. The rigid plastic posts may be sized to frictionally insert between one another to form an interlocking posts engagement when the first and second fasteners are engaged with one another. Further, the array of rigid plastic posts defining the first and second fasteners may be configured to be repositionable and frictionally engaged in different positions of the first fastener relative to the second fastener. Additionally, the shear strength of the connection formed by the first and second fasteners may be at least three times greater than the peel strength thereof. Specifically, the shear strength of the connection formed by the interlocking posts engagement of a pair of fasteners (e.g., one first fastener and one second fastener) may be greater than 4.5 lbf, and the peel strength of the connection formed by the interlocking posts engagement of the pair of fasteners may be less than 1.5 lbf. Alternatively, the shear strength of the connection formed by the interlocking posts engagement of the first and second fasteners may be at least five times greater than the peel strength thereof. Specifically, the shear strength of the connection formed by the interlocking posts engagement of the pair of fasteners (e.g., one first fastener and one second fastener) may be greater than 10 lbf, and the peel strength of the connection formed by the interlocking posts engagement of the pair of fasteners may be less than 2 lbf. In some embodiments, the shear strength of the connection formed by the interlocking posts engagement of the pair of fasteners (e.g., one first fastener and one second fastener) may be greater than or equal to 7 lbf, and the peel strength of the connection formed by the interlocking posts engagement of the pair of fasteners may be less than or equal to 1.1 lbf. Moreover, each of the fastening elements may not include abrasive materials or sharp edges that can potentially scratch a wearer and/or tear a material of the central gown body during donning and doffing. Also, the array of rigid plastic posts may be configured to engage and disengage without collection of debris or lint during use and without risk of connecting to and without agglomerating multiple gowns together during laundering thereof.

In a further embodiment, the rotation of the folded tabs of the fastening elements located at the shoulder region may enable a successful peeling disconnection of the first and second fasteners at similar forces to doffing forces applied to tear open a disposable protective gown, such doffing forces being 5 lbf or less. Additionally, the overlapping section of the back panel may include a terminal edge with a hem where a material defining the back panel is folded over itself and stitched into position. Each of the folded tabs, onto which one of the first and second fasteners is mounted, may extend from a first tab end secured to a first longitudinal edge of the hem to a second tab end secured to an opposite second longitudinal edge of the hem. The first or second fastener may extend from a partial portion of the folded tab between the first and second tab ends, such that the folded tab is thereby configured to fold down generally planar to the hem when the first and second fasteners are engaged to hold the protective gown in a closed position at the shoulder region of the gown. Further, the central gown body may include a ventilation cape formed by a ventilation opening along one of the left and right portions of the back panel.

In yet another embodiment, the rear-opening protective gown may further include a waist closure including a first closure element connected to and extending outwardly away from an edge of the overlapping section of the back panel and a second closure element mounted adjacent to the overlapped section of the back panel and proximate a junction of the front panel and the back panel. The first closure element may carry one of the first fasteners and the second closure element may carry one of the second fasteners to collectively define one of the plurality of fastening elements, which when connected, holds the protective gown closed along a waist region of the gown. Further, the first and second fasteners at the waist closure may be positioned at a location easily accessible to a hand of the wearer such that the first and second fasteners can be disconnected by either pulling apart with the wearer's hand, or by applying the doffing force to the front panel, which is transmitted through the gown to help open both the waist closure and the fastening elements at the shoulder region.

In another embodiment, the waist closure may further include a first elongated tie member extending downwardly from overlapping section of the back panel and a second elongated tie member extending downwardly from the overlapped section of the back panel. The first and second elongated tie members may be configured to be tied together at the waist region of the wearer to hold the protective gown closed along this region as an alternative to engaging the first and second fasteners at the waist closure. Furthermore, the rear-opening protective gown may further include an internal waist closure including a first closure element connected to a free edge of the overlapped section of the back panel and a second closure element mounted inside an interior of the central gown body proximate a junction of the front panel and the back panel. The first closure element carrying one of the first fasteners and the second closure element including one of the second fasteners to collectively define one of the plurality of fastening elements, which when connected, holds the protective gown closed along a waist region of the gown, and with one of the first and second closure elements being mounted on a folded tab to enable transfer of shearing forces to peeling forces to open the fastening element at the internal waist closure.

In a further embodiment, the rear-opening protective gown may further include a pair of pull loops (or tabs) connected to the central gown body along opposite sides of a waist region of the wearer, and specifically along connections of the front panel to the back panel. The pull loops may be sized and positioned to receive or be grasped by one or more fingers of the hands of the wearer to thereby provide convenient gripping locations for the wearer (or another) to apply the doffing force to open and remove the protective gown. The convenient gripping locations may also be positioned away from portions of the protective gown along the front panel most likely to be soiled during use by the wearer. Further, each of the pull loops may be formed from a twill tape loop stitched into connection with the central gown body. Additionally, each of the pull loops may be formed from a material having a highly contrasting color from a material defining the central gown body to guide the wearer to the location where doffing forces should be applied to remove the protective gown.

In another aspect of the invention, a rear-opening protective gown defining a personal protective equipment garment configured for removal by pull-forward doffing action is disclosed. The protective gown includes a central gown body sized to wrap around at least a torso area of a wearer. The central gown body includes a front panel and a back panel, with the back panel being separated into a right portion and a left portion such that the protective gown opens at the back panel. The protective gown further includes a pair of opposing left and right sleeves that cooperate with and extend away from the central gown body for receiving arms of the wearer. The protective gown also includes a neck opening defined by the central gown body adjacent a shoulder region of the central gown body located proximate a junction of the left and right sleeves with the central gown body. The protective gown additionally includes a plurality of fastening elements positioned on or proximate to the back panel, each fastening element including first and second fasteners configured to engage with one another to define a connection having a shear strength greater than a peel strength thereof. For at least some of the fastening elements, one of the first and second fasteners is mounted on a folded tab connected to the corresponding portion of the back panel. The folded tab is pivotable relative to the corresponding portion of the back panel such that when a doffing force is applied by the wearer (or by another) to the protective gown, the folded tab rotates to transfer a shearing force, which is generated by transmission of the doffing force through the central gown body, into a peeling force that peels the first fastener apart from the second fastener. Each of the fastening elements is configured to enable the first fastener to releasably engage with the second fastener in various relative positions and orientations such that the connection defined at each fastening element is repositionable and adjustable, while still enabling the transfer from shearing force to peeling force at the fastening elements.

In one embodiment, for at least some of the fastening elements, one of the first and second fasteners that is not mounted on a folded tab may be formed with an elongated width that is greater than a width of the other of the first and second fasteners, thereby to enable adjustable tightness of closing of the protective gown by engaging the first and second fasteners at different positions and orientations along the elongated width. Further, each of the first and second fasteners may be defined by an array of rigid plastic posts extruded upwardly through a textile backing layer, the rigid plastic posts sized to frictionally insert between one another to form an interlocking posts engagement when the first and second fasteners are engaged with one another.

In another embodiment, at least some of the plurality of fastening elements may be positioned at the shoulder region, and at least some others of the plurality of fastening elements may be positioned at a waist region of the central gown body configured to wrap around a waist of the wearer. Further, a material defining the front panel of the central gown body and the left and right sleeves may be configured to meet barrier and strength performance metrics defined under ANSI/AAMI PB70:2012 and under ASTM F2407-20, thereby avoiding transmission of microorganisms, bodily fluids, or other contaminants through the protective gown.

In yet another aspect of the invention, a method of wearing a rear-opening protective gown is disclosed. The method includes closing a central gown body of the protective gown so that the central gown body is wrapped around at least a torso area of a wearer. The central gown body includes a front panel and a back panel, with the back panel separated into a right portion and a left portion that can lay over one another when the protective gown is closed. The protective gown also including a pair of opposing left and right sleeves and a neck opening. The method further includes securing the central gown body in the closed position by connecting first and second fasteners of a plurality of fastening elements positioned on or proximate to the back panel. The first and second fasteners are configured to engage with one another to define a connection having a shear strength greater than a peel strength thereof. For at least some of the fastening elements, one of the first and second fasteners is mounted on a folded tab connected to and pivotable relative to the back panel. The method also includes doffing the protective gown by pulling the front panel or a waist region of the central gown body to apply a doffing force that transmits to each of the plurality of fastening elements to disconnect the first and second fasteners thereof and thereby allow for opening of the central gown body and removal of the protective gown from a body of the wearer in one single doffing motion. For each of the fastening elements with one of the first and second fasteners mounted on a folding tab, the doffing force is applied as a shearing force that is transferred by rotation of the folding tabs such that the doffing force is instead applied as a peeling force that peels the first fastener apart from the second fastener to allow opening of the plurality of fastening elements without causing damage to the protective gown, thereby allowing for reuse of the protective gown.

In one embodiment, the method may further include disconnecting the first and second fasteners of one of the plurality of fastening elements and reconnecting the first and second fasteners in a different relative position and/or orientation. Each of the fastening elements may be configured to enable repositionable and adjustable connection of the first and second fasteners, while still enabling the transfer from shearing force to peeling force at the fastening elements. Additionally, at least some of the plurality of fastening elements may be positioned at the shoulder region, and at least some others of the plurality of fastening elements may be positioned at a waist region of the central gown body, such that the central gown body is secured and then opened along the shoulder region and along the waist region in the securing and doffing steps.

In another embodiment, a connection defined between the first and second fasteners may define a shear strength greater than a peel strength thereof. The peel strength may be less than 1.5 lbf such that the doffing force necessary to apply to disconnect the fasteners and open the protective gown during the step of doffing the protective gown can be less than 5 lbf. Further, a pair of pull loops may be connected to the central gown body along opposite sides of the waist region. The process of doffing the protective gown may include pulling forward while grasping the pair of pull loops to apply the doffing force to disconnect the fasteners and remove the protective gown from the body of the wearer. The pull loops allow for the doffing force to be applied without directly grasping the front panel of the protective gown—a portion of the gown most likely to be soiled during use by the wearer.

It will be understood that the various embodiments and aspects described above can be combined in any combination or sub-combination without departing from the scope of this disclosure.

BRIEF DESCRIPTION OF THE DRAWINGS

The accompanying drawings are included to provide a further understanding of the embodiments of the invention and are incorporated in and constitute a part of this specification. The drawings illustrate one or more embodiment(s), and together with the detailed description serve to explain principles and operation of the various embodiments. Features and attributes associated with any of the embodiments shown or described may be applied to other embodiments shown, described, or appreciated based on this disclosure.

DETAILED DESCRIPTION

Figure 1:
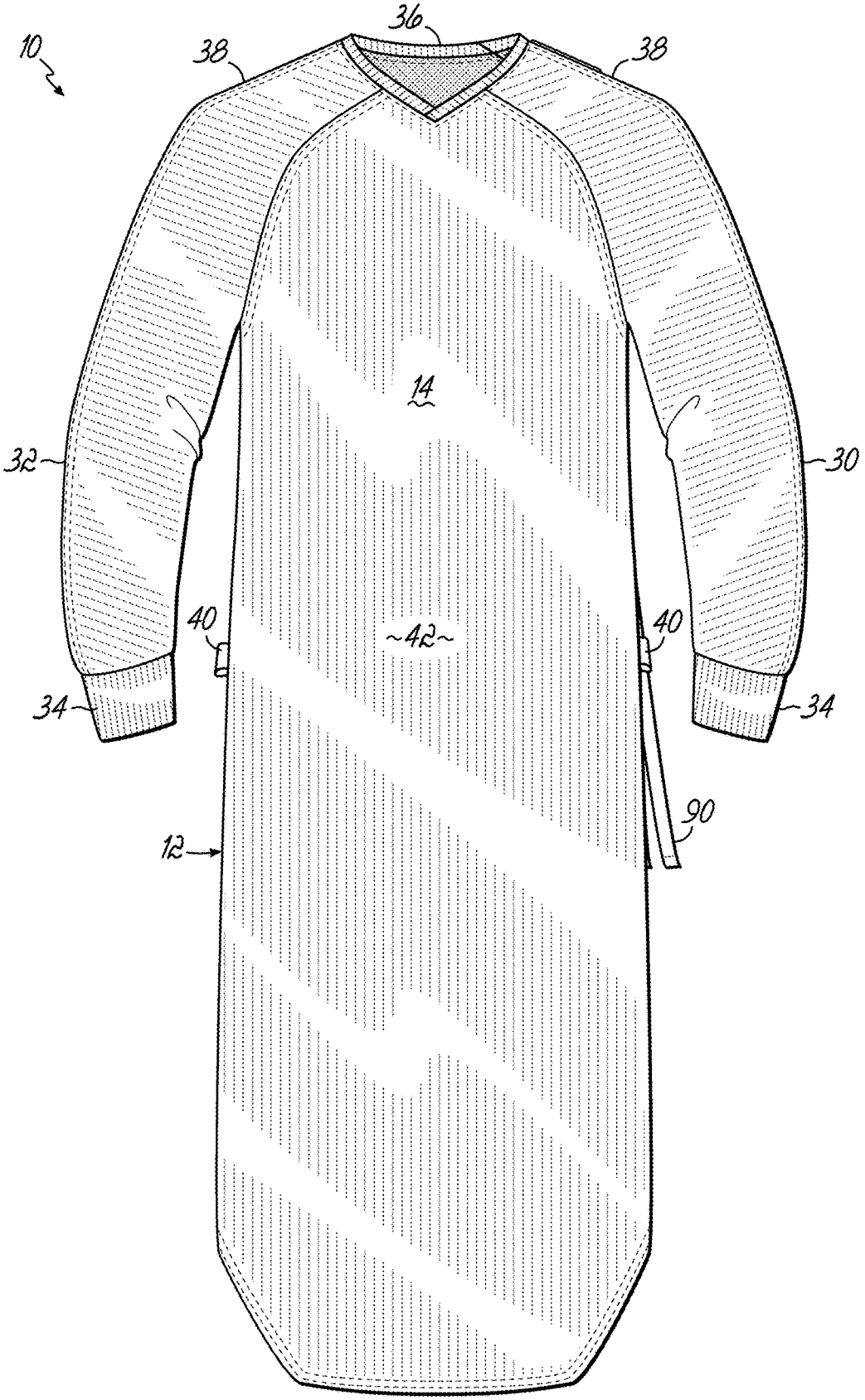
FIG. 1 is a front elevational view of a protective gown according to one embodiment of the present invention, with the protective gown laid substantially flat.

The exemplary embodiments described herein are provided for illustrative purposes and are not limiting. Other exemplary embodiments are possible, and modifications may be made to the exemplary embodiments within the scope of the present disclosure. Therefore, the description below is not meant to limit the scope of the present disclosure.

In general, the description relates to a reusable rear-opening protective gown 10 (also referred to as an isolation gown, a surgical gown, or a barrier gown herein) and a method of wearing the reusable rear-opening protective gown 10. As described above, there are drawbacks or shortcomings of existing isolation or surgical gowns—and specifically, reusable surgical gowns. Advantageously, aspects of the rear-opening surgical gown 10 of the present invention, described in greater detail below, address the drawbacks and shortcomings of existing isolation gowns. Particularly, the gown 10 is configured to facilitate doffing of the gown 10, such as in a pull forward manner that is consistent with how current users of disposable isolation gowns are accustomed to removing such gowns, without substantial risk of damaging (e.g., tearing) the gown 10 such that the gown 10 can actually be reused for multiple laundering, sterilization, and duty cycles while still protecting against contamination. To that end, the gown 10 includes features (described in greater detail below) that secure the gown 10 closed when fastened, but allow for the above-noted doffing action (either by the wearer or by another), while also facilitating ease of adjustment and donning of the gown 10. Further, the gown 10 includes features (described in greater detail below) to further aid in doffing the gown 10. For example, the gown 10 includes a series of fastening elements that are mounted on the gown 10 so as to rotate and allow a shearing force applied to be transferred to a peeling force, which is beneficial in working with the types of fastening elements that allow for the combination of gown functionalities listed above. Other advantages and technical effects of the embodiments of this invention will become evident to one skilled in the art from the following description.

Referring now to the Figures, FIGS. 1-9 show embodiments of the surgical gown 10 (or portions thereof). The surgical gown 10 can take on a variety of forms, as described in greater detail below. For example, the gown 10 can be provided in any number of desired lengths and sizes. Further, the gown 10 may be provided in any color, as desired. The gown 10 also may optionally include pockets (not shown) or other surface features. In one example, a verifiable tracking system (not shown), such as a bar code or radio frequency chip, may be included on or in the gown 10, such as to track the number of laundering cycles of the gown 10, for example. It should be understood that the surgical gown 10 can take on further alternative forms beyond those described herein and depicted in the figures. The particular form of the surgical gown 10 should not be understood to be limited to only the depicted embodiments. Further, use of the descriptive terms such as left, right, top, bottom, front, back, vertical and/or horizontal hereinbelow, for example, as it pertains to/describes the gown 10, is from the viewpoint of a wearer of the gown 10 (when properly donned), unless otherwise noted.

Figure 2:
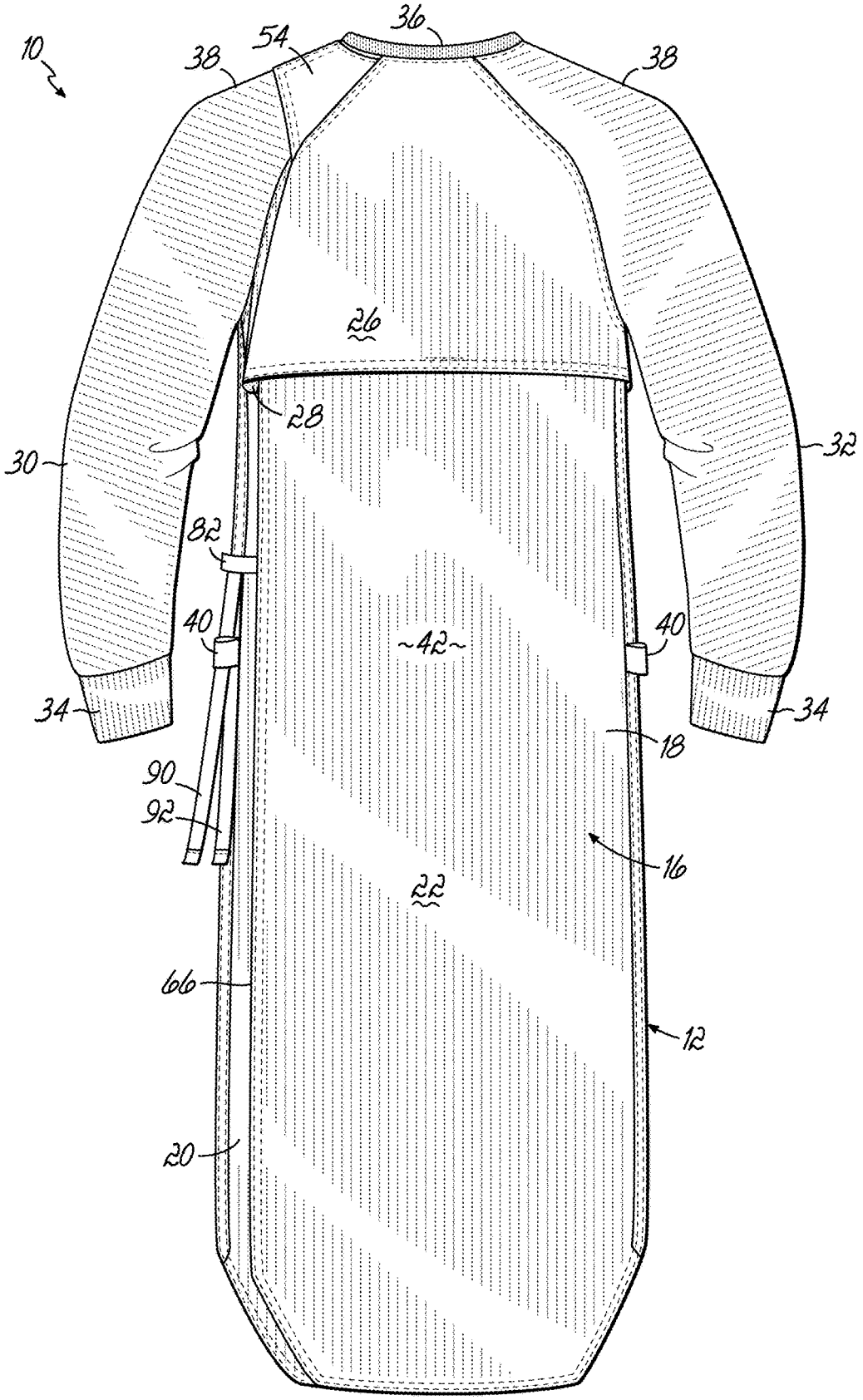
FIG. 2 is a rear elevational view of the protective gown shown in FIG. 1 in a closed and secured position, again laid substantially flat.

Referring now to FIGS. 1 and 2, the Figures show a reusable surgical gown 10 in accordance with an embodiment of the present invention. Specifically, the gown 10 is a rear-opening surgical gown and defines a personal protective equipment (PPE) garment that is configured for removal by a pull-forward doffing action. The gown 10 generally includes a central gown body 12 sized to wrap around at least a torso area of a wearer. The central gown body 12 includes at least a front panel 14 and a back panel 16. As will be described in greater detail below with respect to FIGS. 3A and 3B, the back panel 16 of this embodiment is separated into at least a right portion 18 and a left portion 20 such that the gown 10 opens at the back panel 16 by the separable right and left portions 18, 20.

The right and left portions 18, 20 of the back panel 16 are arranged such that one of the right portion 18 or the left portion 20 includes an overlapping section 22 and the other of the right portion 18 or the left portion 20 includes a corresponding overlapped section 24. The overlapping section 22 and the overlapped section 24 are configured to lay over one another (e.g., with the overlapping section 22 atop the overlapped section 24) when the surgical gown 10 is donned by the wearer and closed. The amount of overlap of the overlapping section 22 may vary as desired. Further, as best shown in FIG. 2, the central gown body 12 of this embodiment includes a ventilation cape 26 formed by a ventilation opening 28 along one of the right portion 18 or the left portion 20 of the back panel 16. In the embodiment depicted in FIG. 2, the ventilation opening 28 is located on the right portion 18 of the back panel 16.

With continued reference to FIGS. 1 and 2, the central gown body 12 further includes a pair of opposing sleeves—left sleeve 30 and right sleeve 32. The central gown body 12 and sleeves 30, 32 of the gown 10 can be constructed of various materials such as conventional materials that are typically used in the construction of isolation gowns. Fabric construction can be woven, non-woven, or knitted. In one example, the fabric construction is a woven plain weave. In another example, the sleeves 30, 32 may be a double needle sleeve construction. The fabric material can include natural and/or synthetic fibers and may be lint free, as desired. In one example, the fabric includes polyester and/or cotton. In another example, the central gown body 12 and/or sleeves 30, 32 are substantially polyester, substantially cotton, or a polyester/cotton blend (e.g., a 50/50 blend).

The sleeves 30, 32 cooperate with and extend away from the central gown body 12 and are configured for receiving the arms of the wearer. As shown here, the sleeves 30, 32 are of a raglan style, but may be of a set-in style. Other sleeve styles may be utilized here as well. The sleeves 30, 32 each have an optional terminal cuff 34. The terminal cuffs 34 can be constructed of the same or different materials than those used for the central gown body 12 or sleeves 30, 32. Fabric construction of the gown 10 or portions thereof can be woven, non-woven, or knitted. The fabric material can include natural and/or synthetic fibers and may be lint free, as desired. In one example, the terminal cuff 34 is a knitted cuff, which can be of a different material than the sleeves 30, 32. In one example, the knitted cuff is substantially polyester, substantially cotton, or a cotton/polyester blend (e.g., a 50/50 blend). In another example, the terminal cuff 34 may be elastic and composed of an elastic material, such as rubber, latex, nitrile, vinyl, and the like. The material or materials (e.g., if two-ply) defining the central gown body 12 (specifically, the front panel 14 of the central gown body 12), the left and right sleeves 30, 32, and/or the terminal cuffs 34 may be configured to meet barrier and strength performance metrics defined under ANSI/AAMI PB70:2012 and under ASTM F2407-20, thereby avoiding transmission of micro-organisms, bodily fluids, or other contaminants through the surgical gown 10.

With continued reference to FIGS. 1 and 2, the sleeves 30, 32 may be joined to the central gown body 12 and the cuffs 34 may be joined to their respective sleeves 30, 32 by techniques known in the art, such as by sewing, adhesive bonding, or ultrasonic welding, for example. One or more of the terminal cuffs 34, in other embodiments, may be absent altogether, with the sleeves 30, 32 simply defining an opening that is hemmed at a distal end of each sleeve 30, 32. In other embodiments, the terminal cuff 34 may be replaced with sleeves 30, 32 having thumb loops, for example. Moreover, although the central gown body 12 and the sleeves 30, 32 are shown as separate pieces joined by means known in the art in FIGS. 1 and 2, for example, it should be appreciated that the central gown body 12 and sleeves 30, 32 could be formed of a single, unitary piece (e.g., of fabric). The gown 10 further includes a neck opening 36 defined by the central gown body 12 adjacent a shoulder region 38 of the central gown body 12 and located proximate a junction of the left and right sleeves 30, 32 with the central gown body 12. The shoulder region 38 is generally defined by a top portion of the central gown body 12 and the tops of the sleeves 30, 32 (the shoulder region 38 is present in this area regardless of where the ends of the sleeves 30, 32 and the beginning of the central gown body 12 are collectively defined).

The gown 10 further includes a pair of pull loops 40 (also referred to as pull tabs) connected to the central gown body 12 along opposite sides (e.g., left and right) of a waist region 42 of the gown 10 (and thus of the wearer). Specifically, in the depicted embodiment, the pull loops 40 are connected to the central gown body 12 along the connection (or connections) of the front panel 14 of the gown 10 to the back panel 16 of the gown 10. In other words, the pull loops 40 may be secured to the central gown body 12 by the same stitching, for example, which connects the front panel 14 and the back panel 16. The pull loops 40 are sized and positioned to receive or be grasped by one or more fingers of the hands of the wearer to provide convenient gripping locations for the wearer (or another) to apply a doffing force to open and remove the surgical gown 10 from the body of the wearer. In other words, a pull loops 40 may function as a "loop" if a wearer (or another) inserts a finger, for example, through the pull loop 40 or the pull loop 40 may function as a "tab" if a wearer (or another) grasps the pull loop 40, but does not insert a finger through the pull loop 40. Furthermore, while the pull loop 40 shown in the Figures is a loop-shaped piece of material, the pull loop 40 may be defined by a planar tab-like piece of material that is not constructed as a loop in other embodiments within the scope of this invention (and this is why such element is sometimes referred to as a pull tab 40). The convenient gripping locations of the pull loops 40 are also positioned away from portions of the surgical gown 10 along the front panel 14 that most likely to be soiled during use by the wearer. In one embodiment, each of the pull loops 40 may be formed from a twill tape loop that is stitched into connection with the central gown body 12. Further, each of the pull loops 40 may be formed from a material having a highly contrasting color from the material defining the central gown body 12 (and/or the sleeves 30, 32) to guide the wearer (or another) to the location where doffing forces may be applied to remove the surgical gown 10.

Figure 3A:
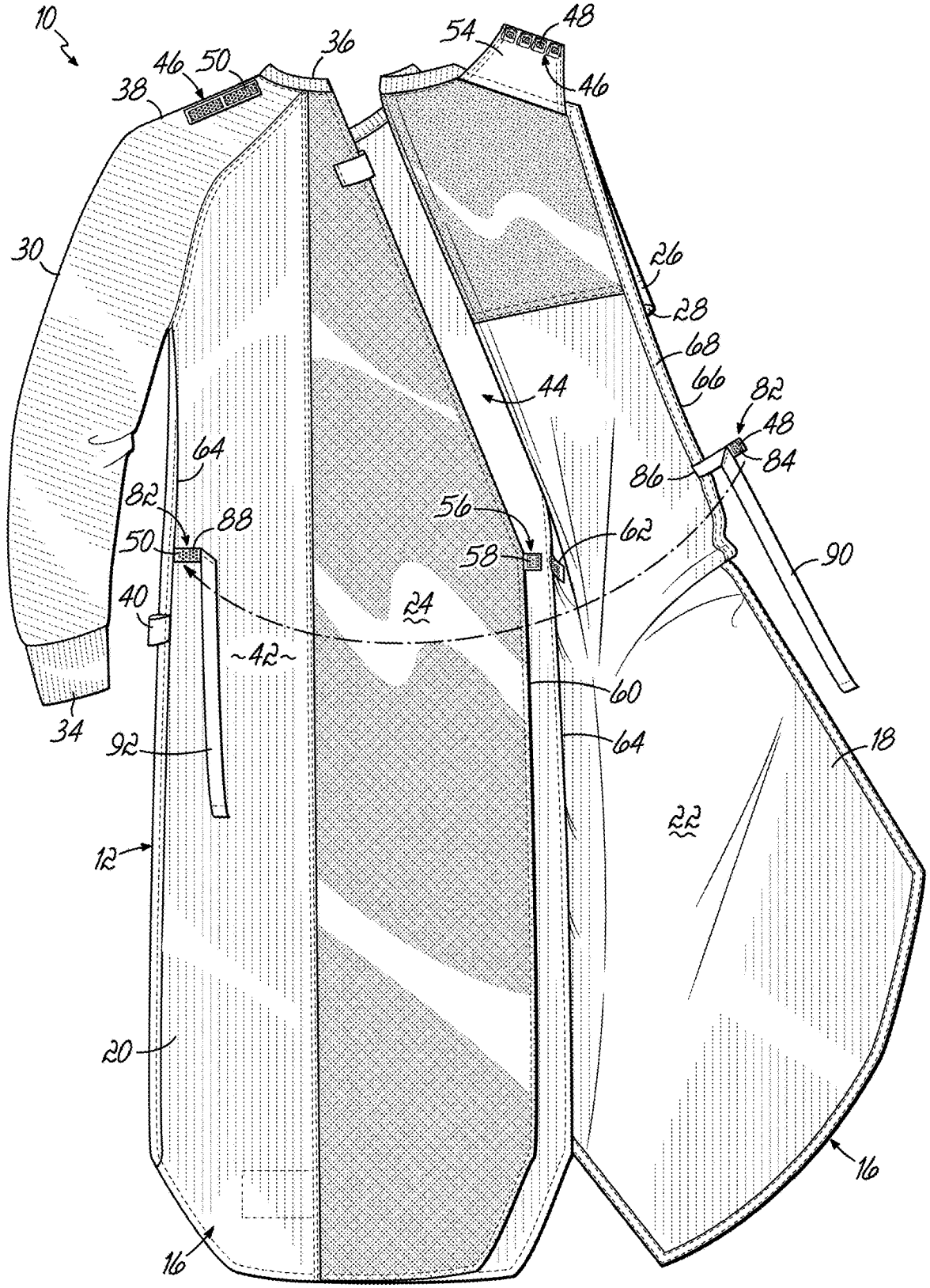
FIG. 3A is an alternative rear elevational view of the protective gown shown in FIG. 1, with a portion of a back panel of the protective gown rotated to an open position to thereby reveal another portion of the back panel in this partially open configuration for the protective gown.
Figure 3B:
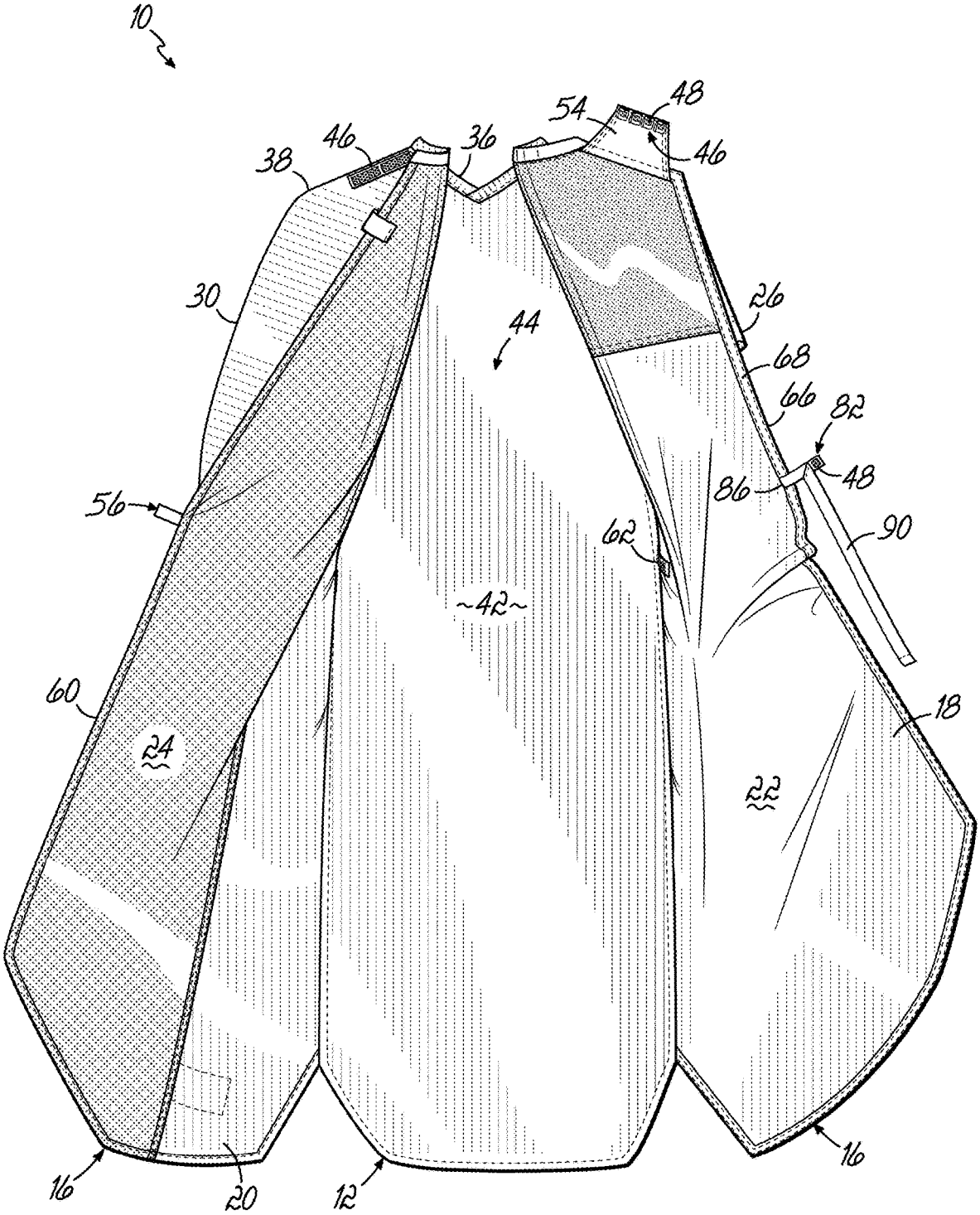
FIG. 3B is a further alternative rear elevational view of the protective gown shown in FIG. 1, with both back panels of the protective gown rotated to an open position to reveal an interior of the protective gown in this open configuration for the protective gown.

Referring now to FIGS. 3A and 3B, the Figures show rear views of the gown 10. In FIG. 3A, the right portion 18 of the back panel 16 is in an open position. In the depicted embodiment, the right portion 18 of the back panel 16 includes the overlapping section 22—which overlaps the overlapped section 24. For clarity, the left portion 20 of the back panel 16 in this embodiment includes the overlapped section 24. It is to be understood that, in alternative embodiments, the right portion 18 and left portion 20 could be switched. That is, the left portion 20 could include the overlapping section 22 and the right portion 18 could include the overlapped section 24 (such that the left portion 20 would overlay the right portion 18). In FIG. 3B, both the right portion 18 and the left portion 20 of the back panel 16 are in an open position revealing an interior 44 of the gown 10.

As shown in both FIGS. 3A and 3B, the gown 10 includes fastening elements 46 positioned on or proximate to the back panel 16. The fastening elements 46 function to close the protective gown 10. It should be appreciated that more or fewer fastening elements 46 may be provided with the gown 10, the locations thereof may be re-located altogether or adjusted up or down and/or left or right, as needed. The fastening elements 46 are provided on the gown 10 to provide a secure, full body fit for a wearer and to facilitate ease of adjustment and donning and removing the gown 10 without substantial risk of the transfer of potentially harmful microorganisms. The fastening elements 46 provide a safe and secure hold when fastened but permit the gown 10 to be removed easily, quickly, and more safely than other reusable options. Removal, which is discussed in more detail below, can be achieved, for example, by pulling forward on the gown 10 in a manner that is consistent with how current users of disposable surgical gowns are accustomed, without substantial risk of damaging (e.g., tearing) the gown 10, while also facilitating ease of adjustment and donning of the gown 10.

To that end, the fastening elements 46 include a desired average peel strength and/or desired average shear strength that allows the fastening elements 46 to come undone when the gown 10 is pulled forward with enough force to accomplish the aforementioned doffing process. The fastening elements 46 are generally configured to have a shear strength significantly greater than a peel strength thereof. Further, the fastening elements 46 are made of material that is able to repeatedly withstand commercial laundering conditions, such as high temperature and/or acidic and/or basic pH conditions, typically encountered by reusable gowns. The fastening elements 46 may be constructed of Block Tapey® (commercially available from Morito Co., Ltd. of Osaka, Japan, for example) or other releasable fasteners known in the art.

With continued reference to FIGS. 3A and 3B, each fastening element 46 includes at least a first fastener 48 and a second fastener 50. First and second fasteners 48, 50 may be secured by techniques known in the art, such as by being sewn, to the back panel 16, for example, of the central gown body 12. The first and second fasteners 48, 50 are configured to engage with one another to define a connection. The fastening elements 46 may be employed to releasably secure the gown 10 closed, for example. Each of the fastening elements 46 is configured to enable the first fastener 48 to releasably engage with the second fastener 50 in various relative positions and orientations such that the connection defined at each fastening element 46 is repositionable and adjustable, while still enabling the transfer from shearing force to peeling force at the fastening elements. It is contemplated that the first fasteners 48 and/or second fasteners 50 may be made up of a plurality of subparts placed closely together to generally define a first fastener 48 and/or a second fastener 50. For example, a number of first fasteners 48 could be placed in series to effectively form a larger first fastener 48. In the depicted embodiment, at least some of the fastening elements 46 are positioned at the shoulder region 38, and at least some others of the fastening elements 46 are positioned at a waist region 42 of the central gown body 12 and are configured to secure the gown 10 closed around a waist of the wearer.

For at least some of the fastening elements 46, at least one of the first and second fasteners 48, 50 is mounted on a folded tab 52 connected to a corresponding portion of the back panel 16. As will be described in greater detail below (with respect to FIGS. 6A-6D, for example), the folded tab 52 is pivotable relative to the corresponding portion of the back panel 16 such that when a doffing force is applied by the wearer (or by another) to the surgical gown 10, the folded tab 52 rotates to transfer a shearing force, which is generated by transmission of the doffing force through the central gown body 12, into a peeling force that effectively peels the first fastener 48 apart from the second fastener 50 (or vice versa). Further, for at least some of the fastening elements 46, one of the first and second fasteners 48, 50 that is not mounted on a folded tab 52 may be formed with an elongated width that is greater than a width of the other of the first and second fasteners 48, 50. This enables adjustable tightness of closing of the surgical gown 10 by engaging the first and second fasteners 48, 50 at different positions and orientations along the elongated width of the one of the first and second fasteners 48, 50 that is not mounted on a folded tab 52. When using fasteners 48, 50 made from a material like Block Tapey® mentioned above, the first and second fasteners 48, 50 can be reoriented relative to one another for successful connection even when these fasteners 48, 50 are identical or similarly sized.

Figure 4:
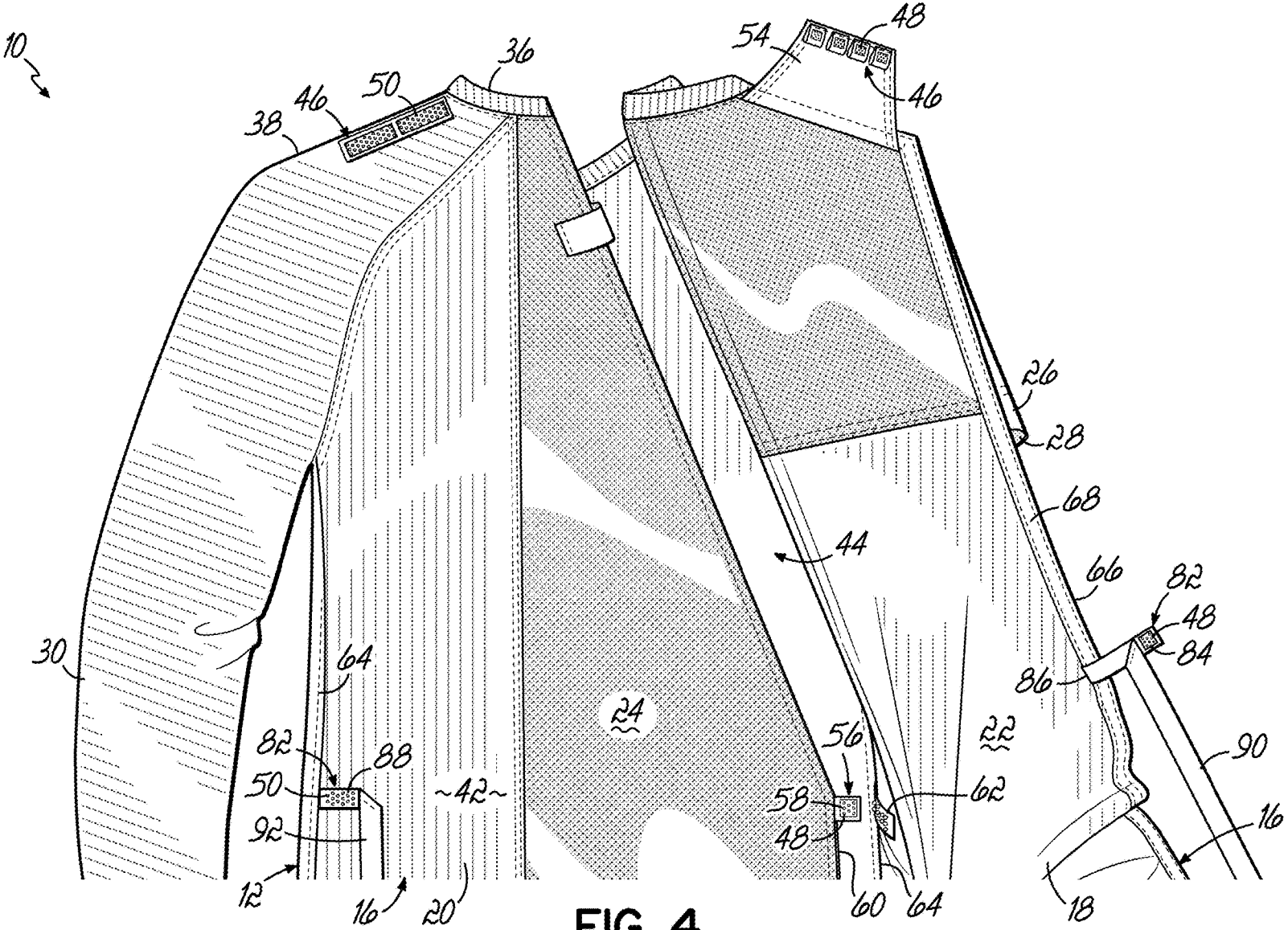
FIG. 4 is a detail rear elevational view of a portion of the protective gown shown in FIG. 1, illustrating the shoulder region of the protective gown.

Referring now to FIG. 4, the Figure shows an enlarged detail view of a portion of the back panel 16 of the gown 10. In the embodiment depicted in FIG. 4, a plurality of fastening elements 46 are positioned on or proximate to the back panel 16. Each fastening element 46 includes a first fastener 48 mounted on the overlapping section 22 of the back panel 16 and a second fastener 50 mounted on the overlapped section 24 of the back panel 16 of the central gown body 12. In the depicted embodiment, at least one of the fastening elements 46 is located at the shoulder region 38 of the central gown body 12. Particularly, for the fastening element 46 that is located at the shoulder region 38, at least one of the first or second fasteners 48, 50 is mounted on a folded tab 52. The other of the first or second fasteners 48, 50 is connected to the back panel 16 at a left side of the shoulder region 38. In the depicted embodiment, at least one of the first or second fasteners 48, 50 is further connected to a shoulder extension 54 which in turn is connected to a corresponding portion of the back panel 16 at the shoulder region 38. More specifically, FIG. 4 illustrates in this example four of the first fasteners 48 each mounted on folded tabs 52 and in side-by-side arrangement on the shoulder extension 54. Different configurations and spacings of fasteners are possible in further embodiments. When properly worn, the first fastener 48 (e.g., on the shoulder extension 54 on the right side of the back panel 16) interfaces with the second fastener 50 (e.g., on the left side of the back panel 16) to secure at least a portion of the gown 10 closed along the shoulder region 38 of the gown 10.

The folded tab 52 is pivotable relative to the back panel 16 such that when a doffing force is applied by the wearer (or by another) to the surgical gown 10, the folded tab 52 rotates to transfer a shearing force that would otherwise be applied to the first and second fasteners 48, 50 into a peeling force, as described in greater detail below with respect to FIGS. 6A-6D. This facilitates doffing of the surgical gown 10 by application of the doffing force to the front panel 14 without causing damage to the surgical gown 10, thereby allowing for the gown 10 to be reused. Specifically, rotation of the folded tab 52 of the fastening element 46 located at the shoulder region 38 enables a successful peeling disconnection of the first and second fasteners 48, 50 at similar forces to doffing forces applied to tear open a disposable surgical gown. For example, such doffing forces may be 5 lbf or less.

With continued reference to FIG. 4, the depicted surgical gown 10 further includes an internal waist closure 56 which holds the surgical gown 10 closed along a waist region 42 of the gown 10. The internal waist closure 56 includes a first internal closure element 58 connected to a free edge 60 of the overlapped section 24 of the back panel 16 and a second internal closure element 62 mounted inside the interior 44 of the central gown body 12 proximate a junction 64 of the front panel 14 and the back panel 16. In the depicted embodiment, the first internal closure element 58 carries at least one of the first fasteners 48 and the second internal closure element 62 carries at least one of the second fasteners 50 to collectively define a fastening element 46. As noted above, when the first internal closure element 58 and the second internal closure element 62 are connected (e.g., by the fastening element 46) the internal waist closure 56 holds the surgical gown 10 closed along a waist region 42 of the gown 10. Further, at least one of the first and second internal closure elements 58, 62 may be mounted on a folded tab 52 to enable transfer of shearing forces to peeling forces to open the fastening element 46 at the internal waist closure 56. It will be understood that the internal waist closure 56 may use tie elements or other fasteners than what is shown in the Figures in other embodiments.

Figure 5A:
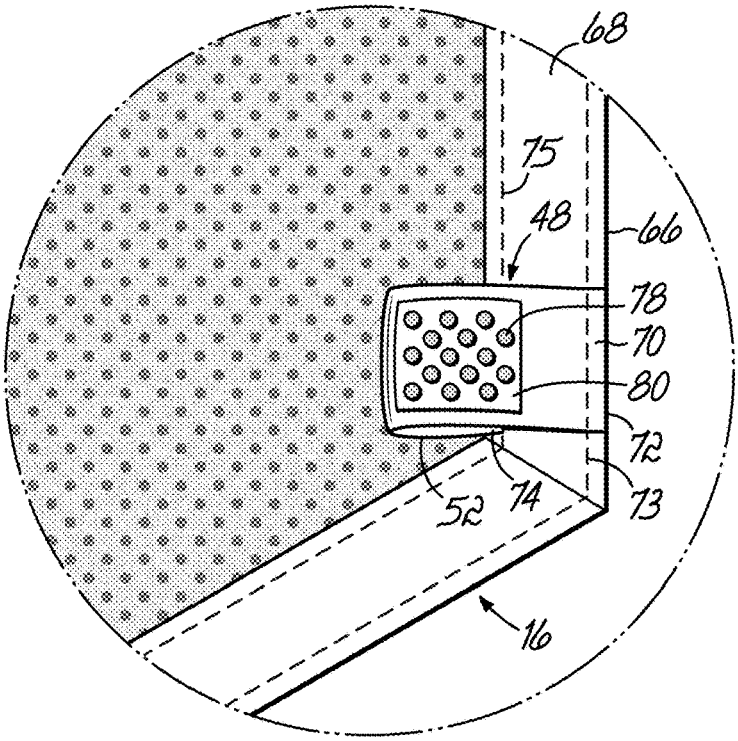
FIG. 5A is a detail plan view of a portion of an exemplary fastening element mounted on a folded tab connected to the back panel of a protective gown.
Figure 5B:
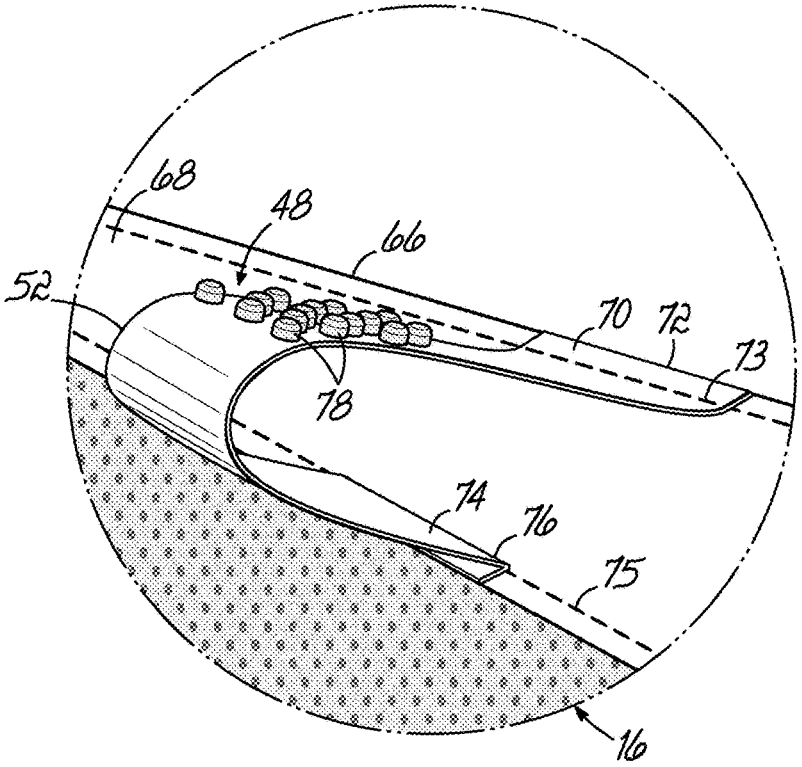
FIG. 5B is a detail perspective view of the portion of the fastening element shown in FIG. 5A.

Referring now to FIGS. 5A and 5B, the Figures show an exemplary folded tab 52 on an overlapping section 22 of a back panel 16, for example. The prior illustrations of fasteners in the Figures are zoomed out and thus shown schematically in those views, e.g., without the mounting tab detail shown clearly, but as described throughout this application, that mounting arrangement helps enable the desirable functionality of the gown 10. FIGS. 5A and 5B show one example of how the tab mounting can be provided, but it will be understood that other alternatives are possible within the scope of the embodiments of this invention. The depicted overlapping section 22 of the back panel 16 includes a terminal edge 66 with a hem 68. To form the hem 68, a material defining the back panel 16 is folded over itself and stitched into position. Each folded tab 52 (onto which a first or second fastener 48, 50 is advantageously mounted), extends from a first tab end 70, which is secured to a first longitudinal edge 72 of the hem 68 by stitching 73, for example, to a second tab end 74, which is secured to an opposite second longitudinal edge 76 of the hem 68 by stitching 75, for example. The first or second fastener 48, 50 extends from a portion of the folded tab 52 between the first and second tab ends 70, 74 such that the folded tab 52 folds down in a generally planar configuration relative to the hem 68 when the first or second fastener 48, 50 engages with a corresponding second or first fastener 50, 48 to collectively form a fastening element 46 and hold the surgical gown 10 in a closed position (e.g., at the shoulder region 38 or waist region 42 of the gown 10).

Figure 6A:
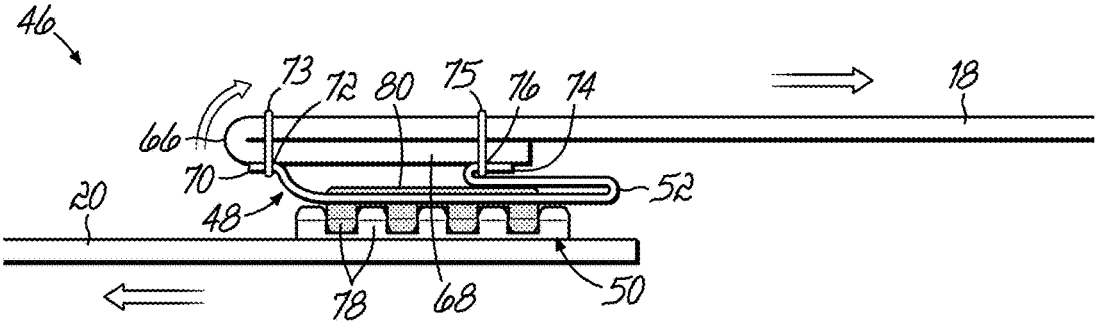
FIG. 6A is a side schematic view of first and second fasteners of the fastening element engaged with each other to secure the overlapping and overlapped sections of the back panel of the protective gown shown in FIG. 1.

Referring now to FIGS. 6A-6D, the Figures illustrate the process of separating a first fastener 48 from a second fastener 50 that collectively form a fastening element 46 and specifically how the tab mounting enables transmission of the doffing force applied. FIG. 6A shows the first fastener 48 engaged with the second fastener 50 to collectively form a fastening element 46. Generally, each of the first and second fasteners 48, 50 in this embodiment is defined by an array of rigid plastic posts 78 extruded (or otherwise protruding) upwardly through a textile backing layer 80. The rigid plastic posts 78 are sized so as to frictionally insert between one another to form an interlocking posts engagement when the first and second fasteners 48, 50 are engaged with one another. The array of rigid plastic posts 78 defining the first and second fasteners 48, 50 are repositionable and capable of being frictionally engaged in different positions of the first fastener 48 relative to the second fastener 50. Such fastening element 46 may be constructed of Block Tapey® (commercially available from Morito Co., Ltd. Of Osaka, Japan, for example) or other releasable fasteners known in the art, for example.

Figure 6B:
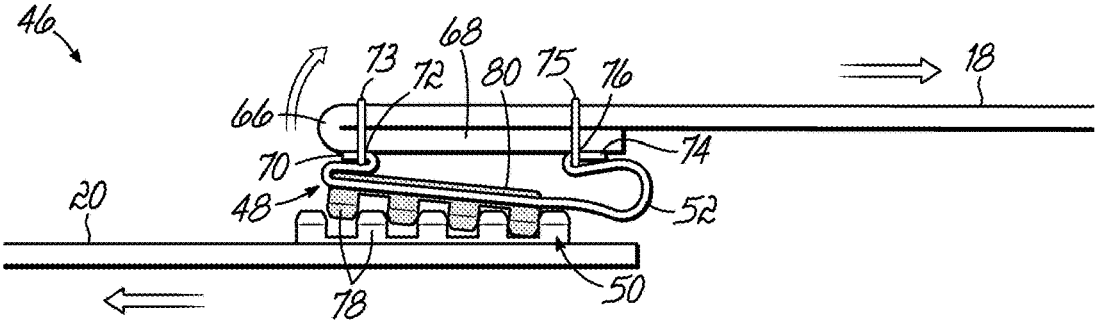
FIG. 6B is a further side schematic view of the first and second fasteners of FIG. 6A, showing a transfer of shearing force into a peeling force.
Figure 6C:
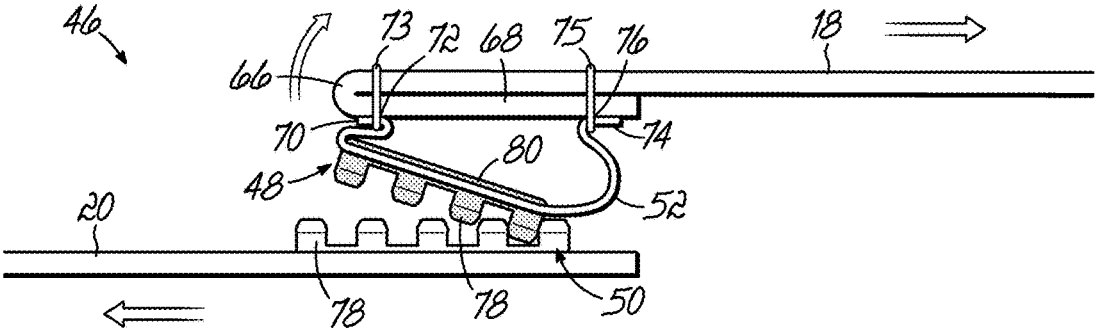
FIG. 6C is a further side schematic view of the first and second fasteners of FIG. 6A, showing the peeling of the first fastener from the second fastener.
Figure 6D:
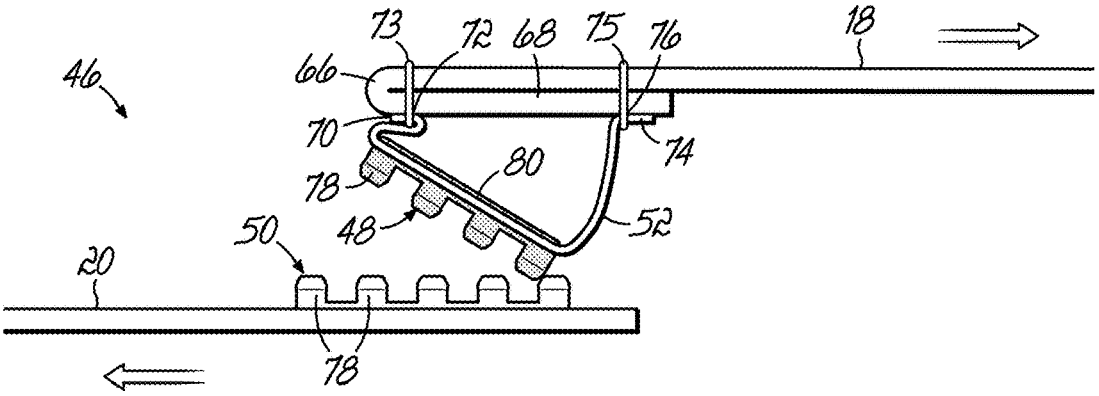
FIG. 6D is a further side schematic view of the first and second fasteners of FIG. 6A, showing separation between the first and second fasteners.

FIGS. 6B and 6C show the first fastener 48 being removed from the second fastener 50. In the depicted embodiment, the first fastener 48 is mounted to a folded tab 52. The folded tab 52 is pivotable such that the folded tab 52 translates a laterally applied force to a (substantially) perpendicularly applied force. For example, when a doffing force is applied by the wearer (or by another) to the surgical gown 10 (e.g., via pull loops 40 on a front panel 14 of the gown 10), the folded tab 52 rotates to transfer a shearing force (transmitted through the central gown body 12), applied to the first and second fasteners 48, 50, into a peeling force that peels the first fastener 48 apart from the second fastener 50. As indicated by FIG. 6D, this facilitates removal of the surgical gown 10 by application of the doffing force to the front panel 14 (e.g., by the pull loops 40) without causing damage to the surgical gown 10, thereby allowing for the gown 10 to be reused.

With continued reference to FIGS. 6A-6D, the shear strength of the connection formed by the interlocking posts 78 engagement of the first and second fasteners 48, 50 is at least three times greater than the peel strength thereof. Specifically, the shear strength of the connection formed by the interlocking posts 78 engagement of a pair of fasteners 48, 50 (e.g., one first fastener and one second fastener) may be greater than or equal to 4.5 lbf and the peel strength of the connection formed by the interlocking posts 78 engagement of the pair of fasteners 48, 50 may be less than or equal to 1.5 lbf. Alternatively, the shear strength of the connection formed by the interlocking posts engagement of the pair of fasteners may be at least five times greater than the peel strength thereof. Specifically, the shear strength of the connection formed by the interlocking posts engagement of the pair of fasteners (e.g., one first fastener and one second fastener) may be greater than or equal to 10 lbf, and the peel strength of the connection formed by the interlocking posts engagement of the pair of fasteners may be less than or equal to 2 lbf. In some embodiments, the shear strength of the connection formed by the interlocking posts engagement of the pair of fasteners (e.g., one first fastener and one second fastener) may be greater than or equal to 7 lbf, and the peel strength of the connection formed by the interlocking posts engagement of the pair of fasteners may be less than or equal to 1.1 lbf. It should be understood that multiple pairs of fasteners 48, 50 may be connected to increase the securement strength and reliability beyond the shear/peel strength described above for a single pair of fasteners 48, 50. Even when utilizing multiple pairs of fasteners 48, 50, the protective gown 10 allows for a quick and clean doffing process.

Advantageously, the fastening element 46 does not include abrasive materials or sharp edges (unlike hook and loop fastener, for example) that can potentially scratch a wearer and/or tear a material of the central gown body 12 during donning and doffing and/or commercial laundering. Such fastener construction therefore contributes to the reusability of the gown 10 of the present invention. Further, the array of rigid plastic posts 78 of the first and second fasteners 48, 50 is configured to engage and disengage without collection of debris or lint (unlike hook and loop fastener, for example) during use and without risk of connecting to and without agglomerating multiple gowns 10 together during laundering thereof. Such a configuration further contributes to the reusability of the gown 10 of the present invention.

Figure 7A:
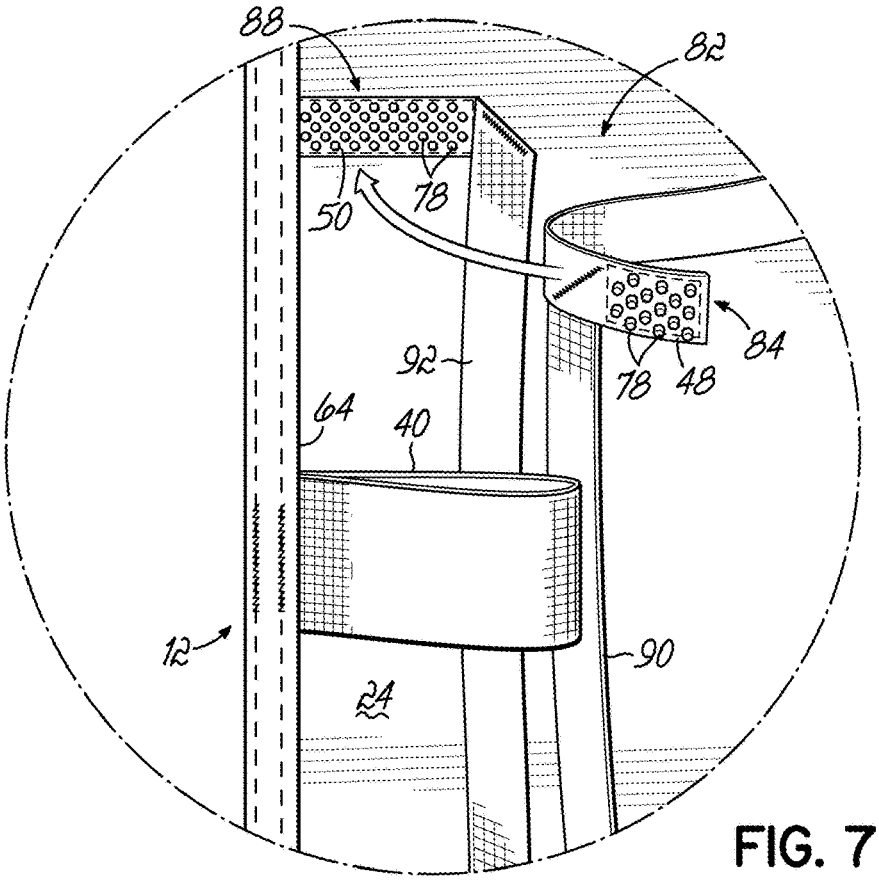
FIG. 7A is a detail perspective view of a waist closure of the of the protective gown shown in FIG. 1.
Figure 7B:
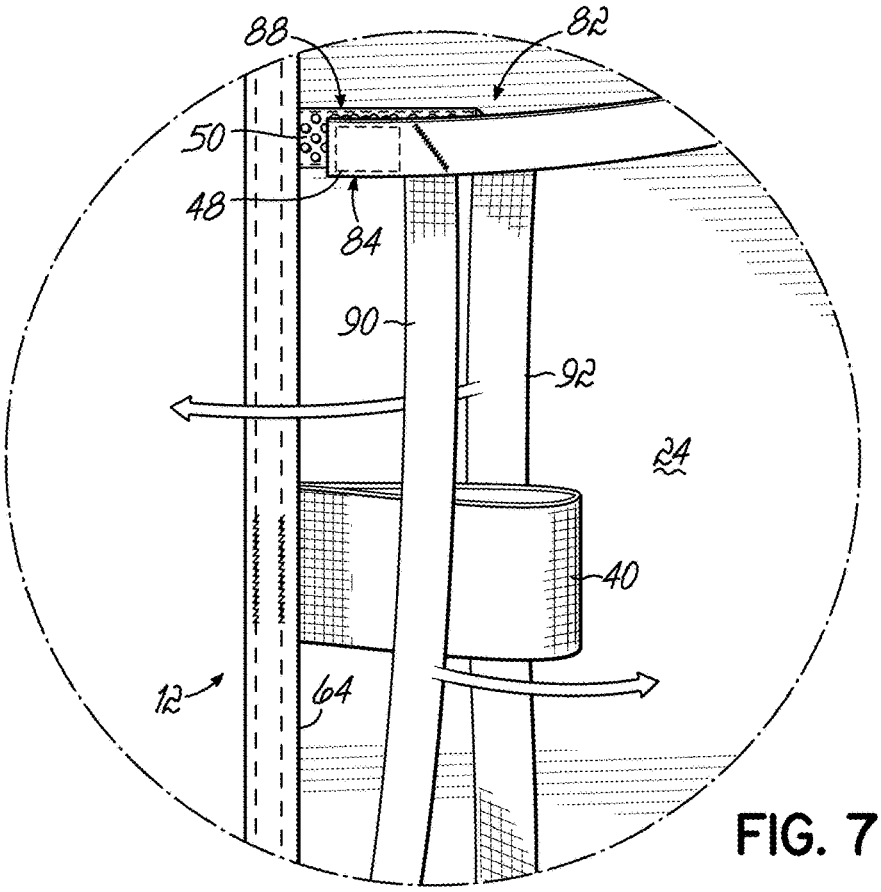
FIG. 7B is a further detail perspective view of the waist closure of the of the protective gown shown in FIG. 1.

Referring now to FIGS. 7A and 7B, the Figures show detail views of an external waist closure 82. The external waist closure 82 may be included on the gown 10 in addition to or in lieu of the internal waist closure 56. The external waist closure 82 includes a first external closure element 84 connected to and extending outwardly away from an edge 86 (FIG. 3A) of the overlapping section 22 of the back panel 16. The external waist closure 82 further includes a second external closure element 88 mounted adjacent to the overlapped section 24 of the back panel 16 and proximate a junction 64 of the front panel 14 and the back panel 16. The first external closure element 84 includes at least one of the first fasteners 48 and the second external closure element 88 includes at least one of the second fasteners 50 to collectively define a fastening element 46.

When the first fastener 48 of the first external closure element 84 and the second fastener 50 of the second external closure element 88 are connected, the external waist closure 82 holds the surgical gown 10 closed along a waist region 42 of the gown 10. The first and second fasteners 48, 50 at the external waist closure 82 are positioned at a location easily accessible to a hand of the wearer. For example, in the depicted embodiment the first and second fasteners 48, 50 (when engaged together) are positioned near to a pull loop 40 at a junction 64 of the front and back panels 14, 16 at roughly a waist region 42 of the gown 10. Such positioning provides that the first and second fasteners 48, 50 can be disconnected by either pulling apart with the wearer's hand, or by applying a doffing force to the front panel 14 (in this circumstance, tab mounting of fasteners may be used as described above), which is then transmitted through the gown 10 to help open both the internal and external waist closures 56, 82 (if applicable) as well as the fastening element(s) 46 at the shoulder region 38 (if applicable).

With continued reference to FIGS. 7A and 7B, the first external closure element 84 may optionally include a first elongated tie member 90 extending downwardly from the first external closure element 84. Similarly, the second external closure element 88 may optionally include a second elongated tie member 92 extending downwardly from the second external closure element 88. Each tie member 90, 92 may be formed of twill tape. Further, the first elongated tie member 90 and the second elongated tie member 92 may be secured by techniques known in the art, such as by being sewn, to the central gown body 12. To this end, the first and second elongated tie members 88, 90 are shown connected to the closure elements 84, 88, but they may be instead secured at some other location to the central gown body 12 while remaining proximate to the other waist closure elements. The first and second elongated tie members 90, 92 are configured to be tied together at or near the waist region 42 of the wearer to further assist in holding the surgical gown 10 closed along the waist region 42 as an alternative (or in addition to) to engaging the first and second fasteners 48, 50 of the external waist closure 82. Regardless, these elements are all located at a position convenient for quick untying or disconnection before doffing force is applied.

Figure 8B:
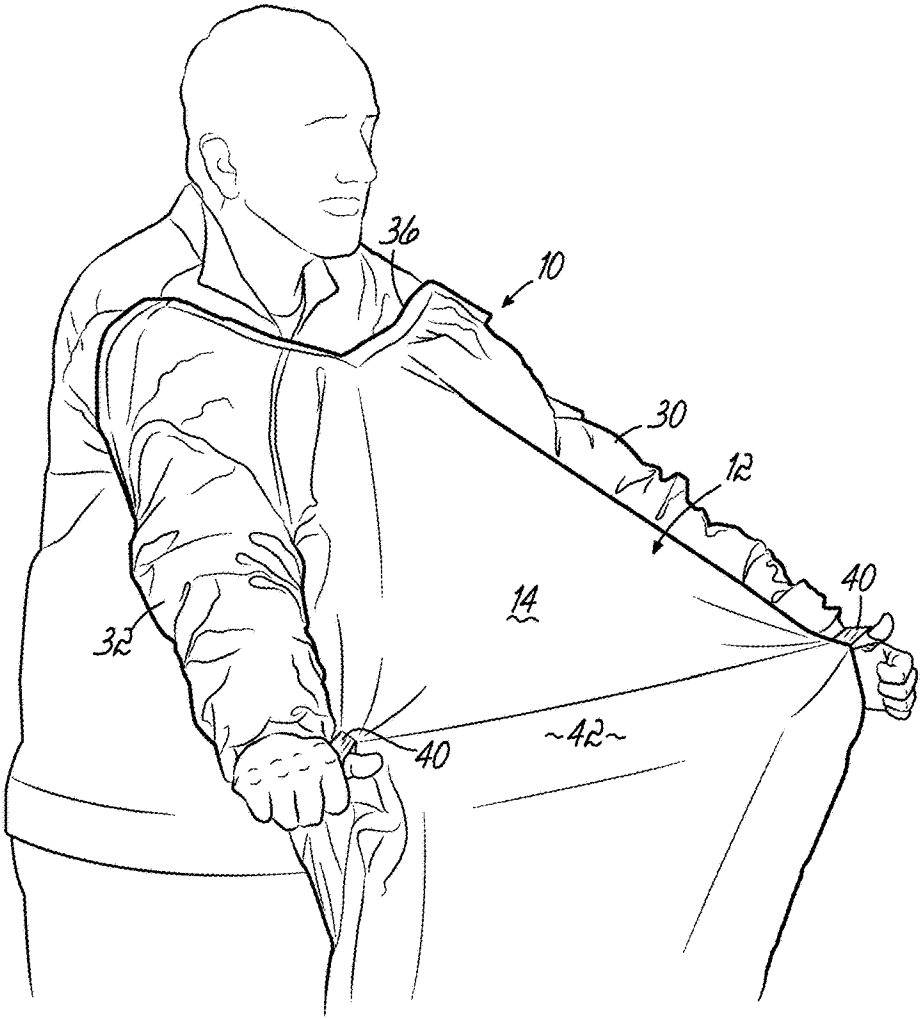
FIGS. 8A and 8B illustrate a doffing method for the protective gown using a pair of pull loops connected to the central gown body, according to one embodiment of the present invention.
Figure 8A:
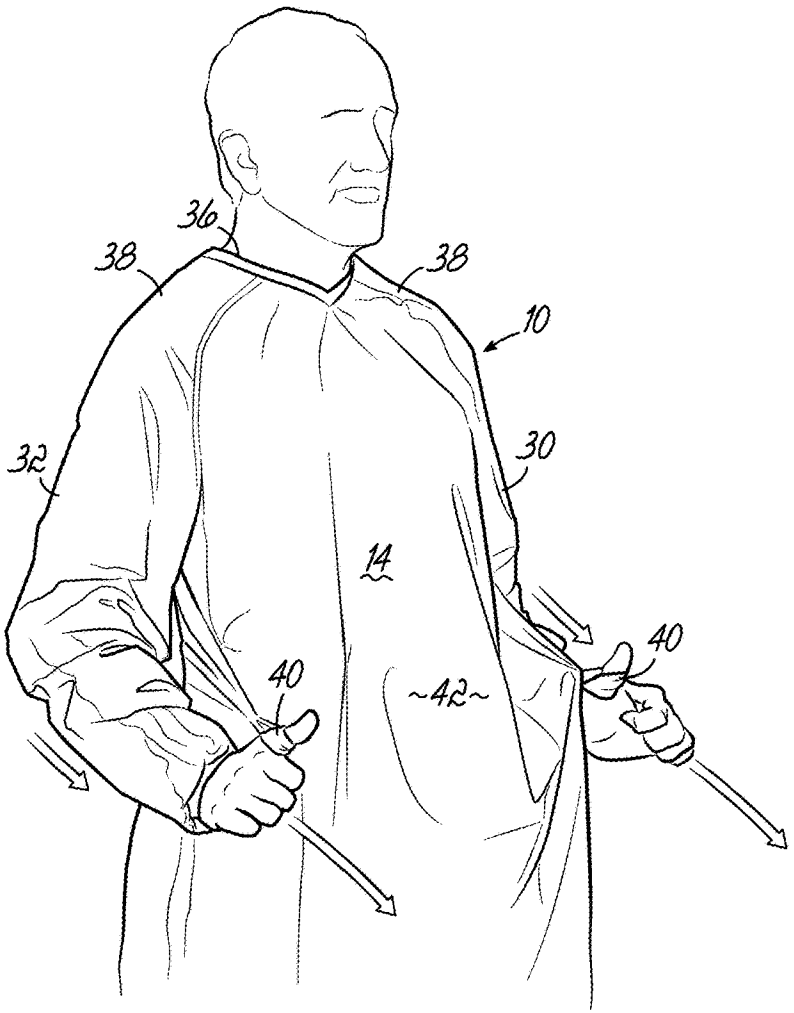
Figure 9B:
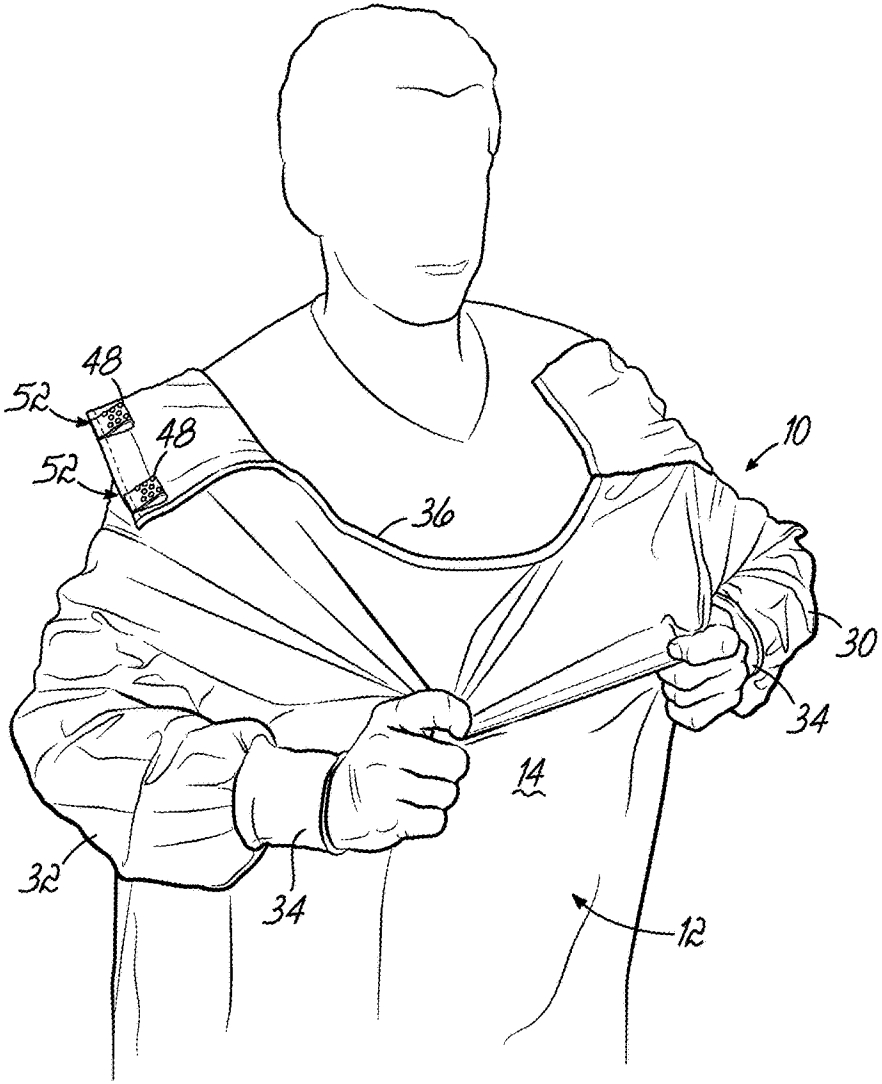
FIGS. 9A and 9B illustrate a doffing method for the protective gown by gripping a front panel of the central gown body, according to an alternative embodiment of the present invention.
Figure 9A:
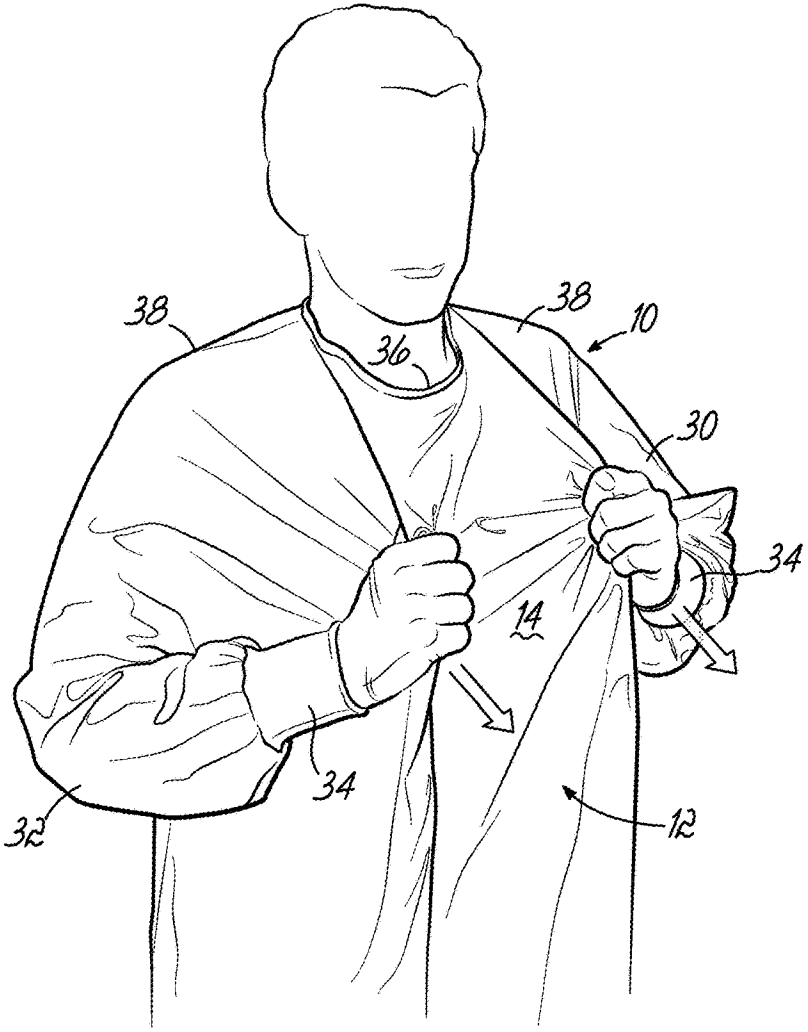
Figure 10:
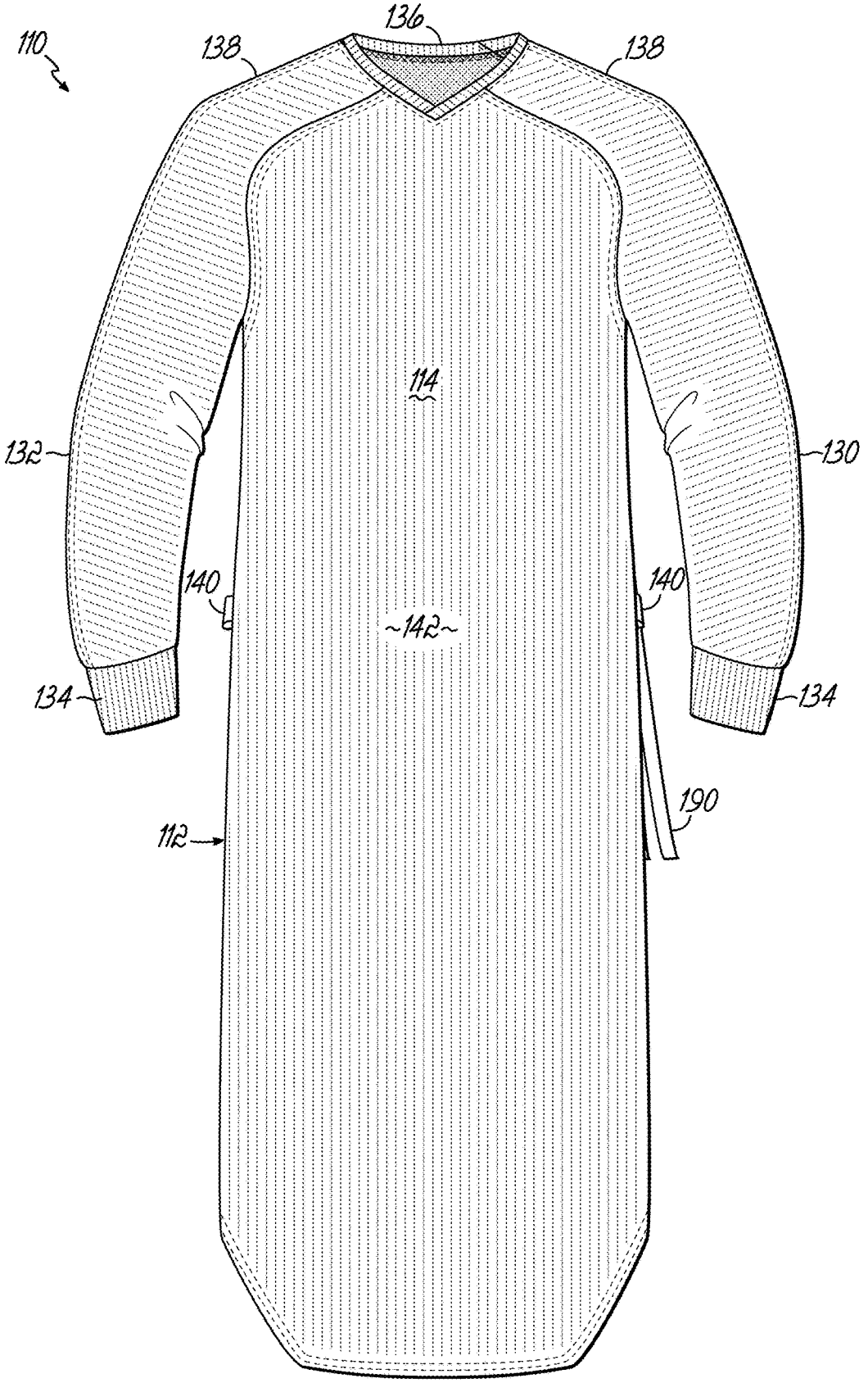
FIG. 10 is a front elevational view of a protective gown according to an alternative embodiment of the present invention, with the protective gown laid substantially flat.
Figure 11:
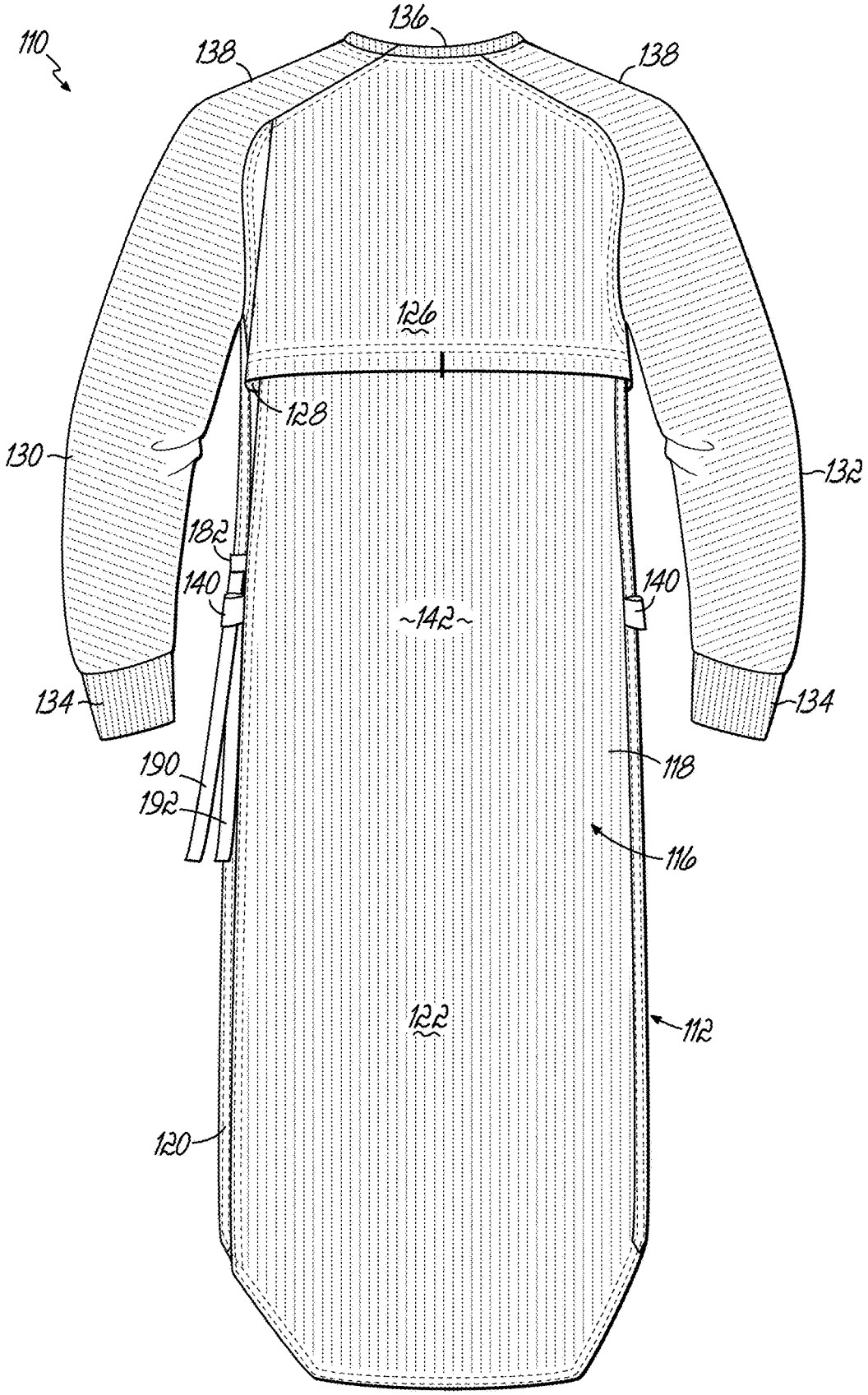
FIG. 11 is a rear elevational view of the protective gown shown in FIG. 10 in a closed and secured position, again laid substantially flat.

Referring now to FIGS. 8A-9B, the Figures show two distinct ways to remove the surgical gown 10 from a body of the wearer in a single doffing motion performed by the wearer. In FIGS. 8A and 8B, the wearer doffs the surgical gown 10 by pulling on pull loops 40 located proximate the waist region 42 of central gown body 12. A wearer may insert his or her thumb (or finger) through the pull loops 40 or a wearer may simply grip an exterior of the pull loops 40. In FIGS. 9A and 9B, the wearer doffs the surgical gown 10 by pulling the front panel 14 (or, alternatively, a waist region 42) of the central gown body 12. Such self-doffing helps to avoid contamination, particularly back contamination. Alternative methods of doffing the gown 10 are contemplated. For example, a wearer may grip a back panel 16 of the gown 10 and pull the back panel 16 of the gown 10 forward and achieve the same doffing effect. Regardless of how the wearer chooses to doff the surgical gown 10 (e.g., by using the pull loops 40 or by pulling some portion of the gown 10), the doffing process generally works in a similar fashion. Further, it should be understood that the doffing action could be performed by someone other than the wearer. For example, a nurse could perform the doffing action on a protective gown 10 worn by a surgeon. However, time and labor efficiencies are achieved through self-doffing by the wearer of the protective gown 10 (e.g., by allowing surgical staff to prepare for the next procedure or attend to an emergency instead of helping a surgeon doff his or her protective gown 10).

Specifically, the gown 10 can be removed via a "pull forward" method that is consistent with how current users of disposable tearaway surgical gowns are accustomed to removing such gowns. The wearer (or another) applies a doffing force (e.g., by using the pull loops 40 or by pulling some portion of the front panel 14) by pulling forcefully forward or away from the central gown body 12. The doffing force transmits through the central gown body 12 to each of the plurality of fastening elements 46 still connected together on the gown 10 (e.g., at the shoulder region 38 and/or at the waist region 42). With sufficient force applied, the corresponding parts of the first fastener 48 and the second fastener 50 of the fastening elements 46 pull apart/become undone, as described in detail above. The force disconnects the first and second fasteners 48, 50 of the fastening elements 46 through use of the folded tab 52. Particularly, the doffing force is applied by the wearer (or by another) as a shearing force through the central gown body 12. Through its rotation, the folded tab 52 translates the applied shearing force (i.e., the force of the "doff") into a peeling force that peels the first fastener 48 apart from the second fastener 50 to allow opening of the plurality of fastening elements 46. Such allows for opening of the central gown body 12 and removal of the surgical gown 10 from a body of the wearer in one single doffing motion. Further, translation of the applied shearing force to a peeling force via the folded tab 52 allows for doffing without causing damage to the surgical gown 10, thereby allowing for reuse of the surgical gown 10.

With continued reference to FIGS. 8A-9B, other variations and modifications to the pull forward (doffing) method can be appreciated by those skilled in the art. Such doffing is performed without substantial risk of damaging (e.g., tearing) the gown 10 and without substantial risk of the transfer of potentially harmful microorganisms, body fluids, and/or particulate material, to the neck or hair on the head or neck of a wearer. To that end, the doffing method eliminates the need to actively undo/untie a set of backside fasteners (besides the first and second elongated tie members 90, 92, if used), and eliminates an opportunity for the wearer to inadvertently touch their hair or neck during the doffing process with potentially contaminated gloves, thereby providing for safer removal of the gown 10 after use. Thereafter, the reusable gown 10 can be subjected to commercial laundering to clean and sanitize the gown 10 for reuse.

Figure 12:
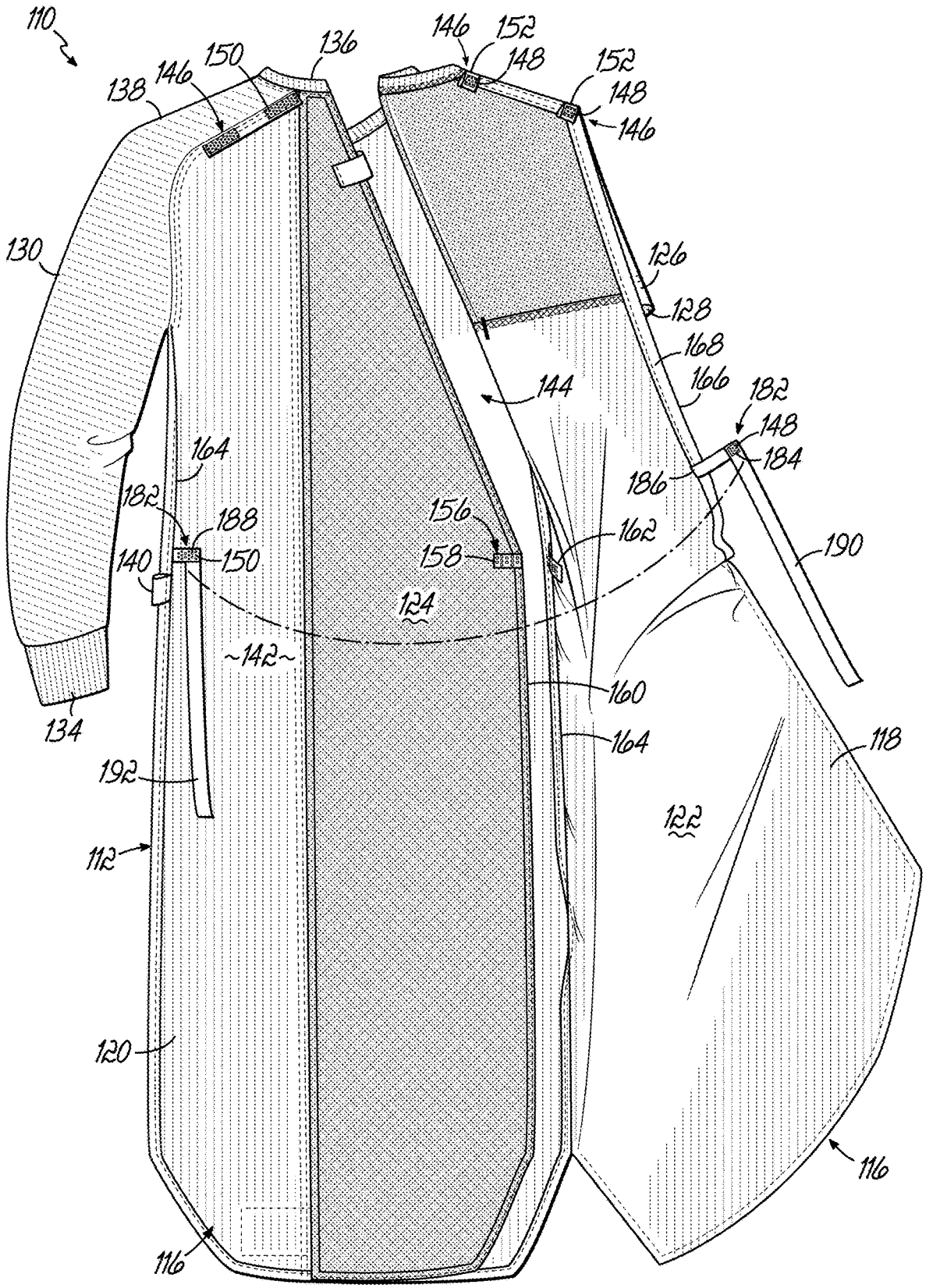
FIG. 12 is an alternative rear elevational view of the protective gown shown in FIG. 10, with a portion of a back panel of the protective gown rotated to an open position to thereby reveal another portion of the back panel in this partially open configuration for the protective gown.
Figure 13:
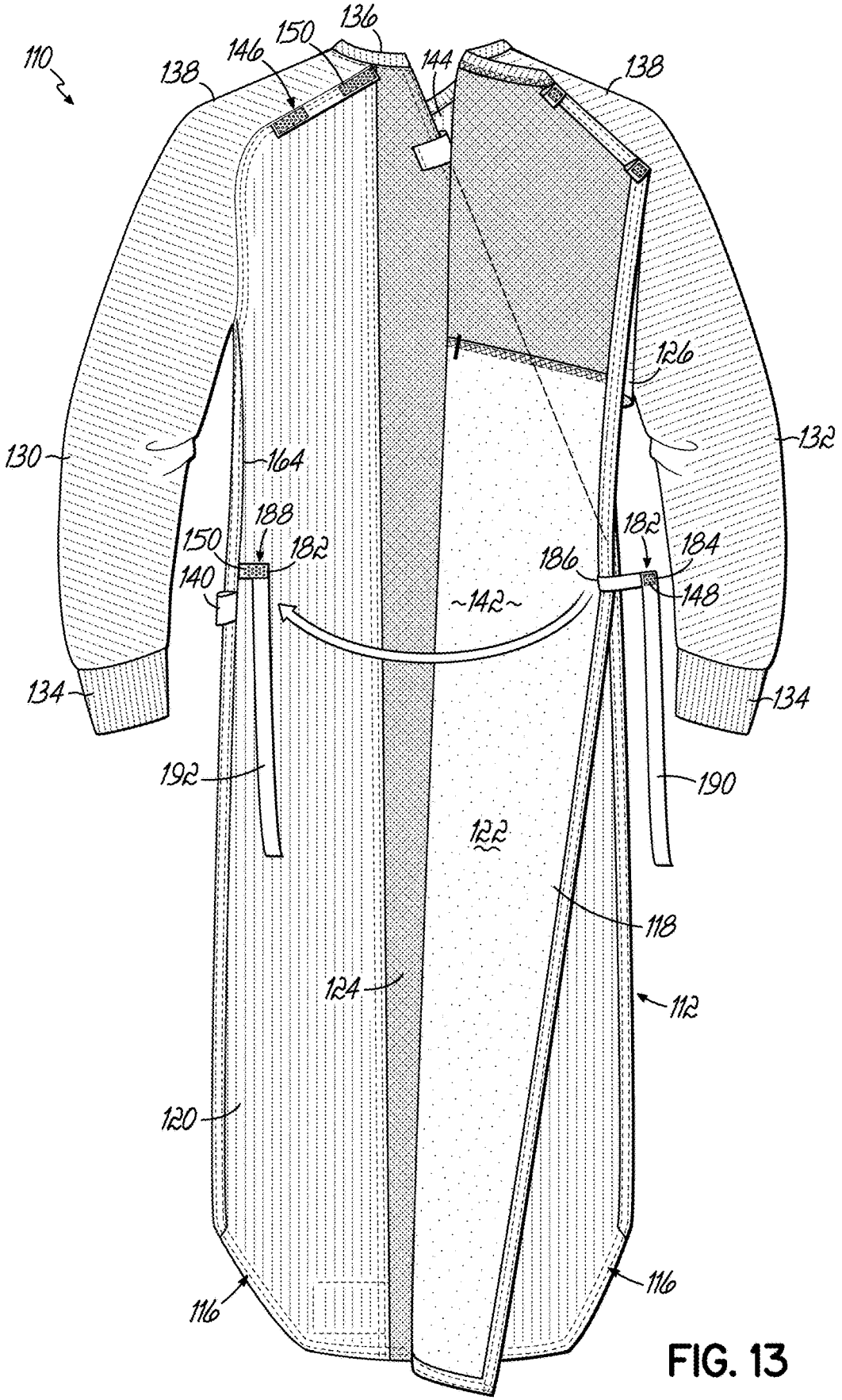
FIG. 13 is a further alternative rear elevational view of the protective gown shown in FIG. 10, illustrating how the gown is secured closed from the open position.

Referring now to FIGS. 10-13, the Figures show an alternative embodiment of the surgical gown 10. The surgical gown 110 of FIGS. 10-13 includes substantially all of the same elements as the surgical gown 10 of FIGS. 1-9B (except for the shoulder extension 54, for example). These elements are provided with similar reference numbers in the 100 series without further explanation below except for the differences in the alternative embodiment of the surgical gown 110. For example, the central gown body 112 (shown in FIG. 10, for example) is analogous to the gown body 12 (shown in FIG. 1, for example), the front panel 114 (shown in FIG. 10, for example) is analogous to the front panel 14 (shown in FIG. 1, for example), the back panel 116 (shown in FIG. 11, for example) is analogous to the back panel 16 (shown in FIG. 2, for example), and so on. As shown most clearly in FIGS. 12 and 13, a first fastener 148 located at a shoulder region 138 of the gown 110 is not mounted on a shoulder extension 54. Instead, the first fastener 148 is secured on a folded tab 152 on the overlapping section 122 of the back panel 116 of the central gown body 112. Such simplifies construction of the surgical gown 110 and reduces the amount of material necessary for the surgical gown 110. Further, the absence of the shoulder extension 54 may alter the amount of force needed to doff the gown 110 (e.g., in comparison to gown 10). To account for the lack of a shoulder extension 54, the second fastener 150 on back panel 116 may be relocated. For example, as shown in FIGS. 12 and 13, the second fastener 150 may be relocated inwards to or towards the overlapped section 124 of the back panel 116 such that when the central gown body 112 is closed, the first fastener 148 on the overlapping section 122 engages with the second fastener 150 on the overlapped section 124 to collectively form a fastening element 146.

Figure 14:
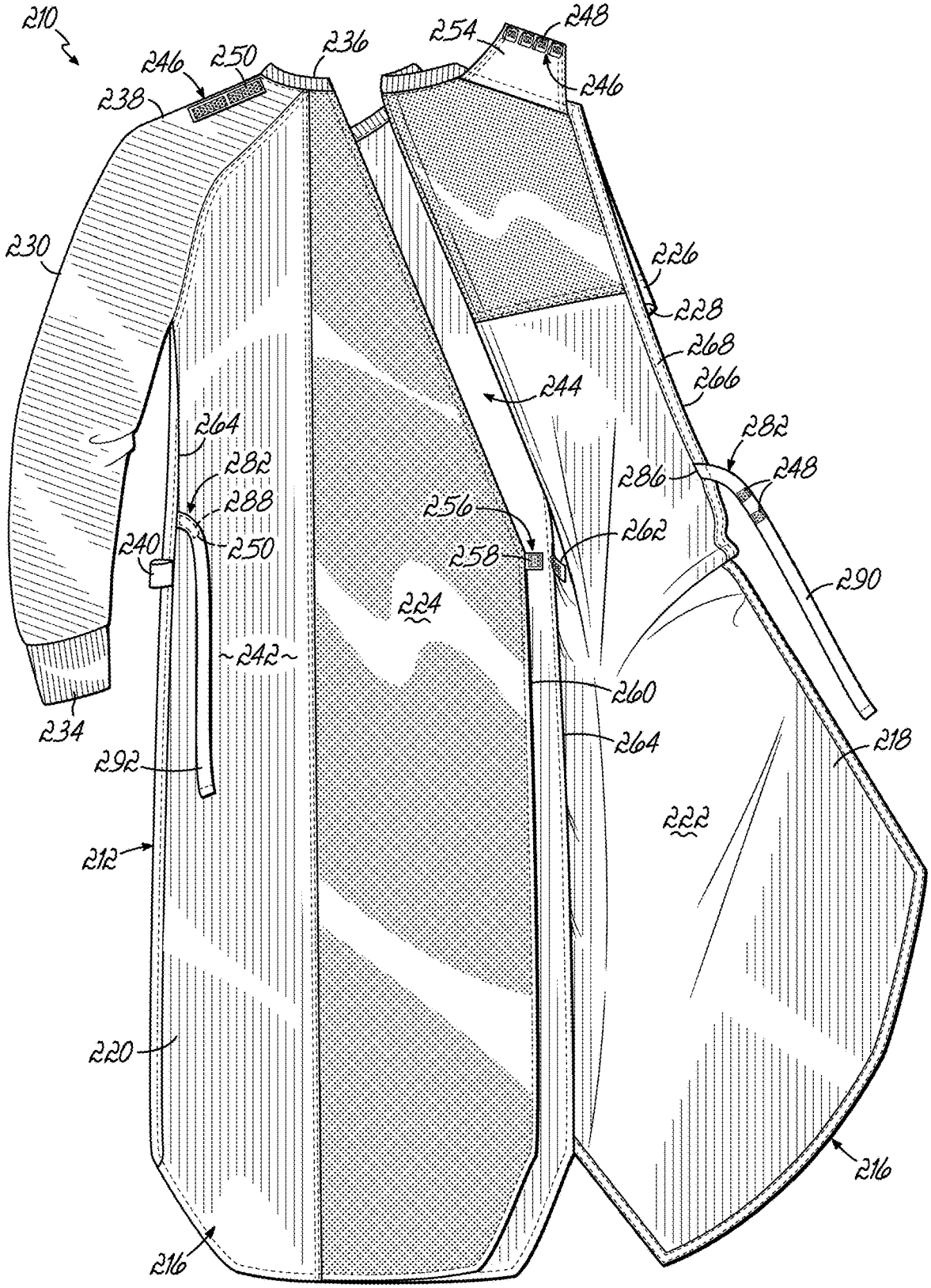
FIG. 14 is a rear elevational view of the protective gown according to an alternative embodiment of the present invention, with a portion of a back panel of the protective gown rotated to an open position to thereby reveal another portion of the back panel in this partially open configuration for the protective gown.
Figure 14A:
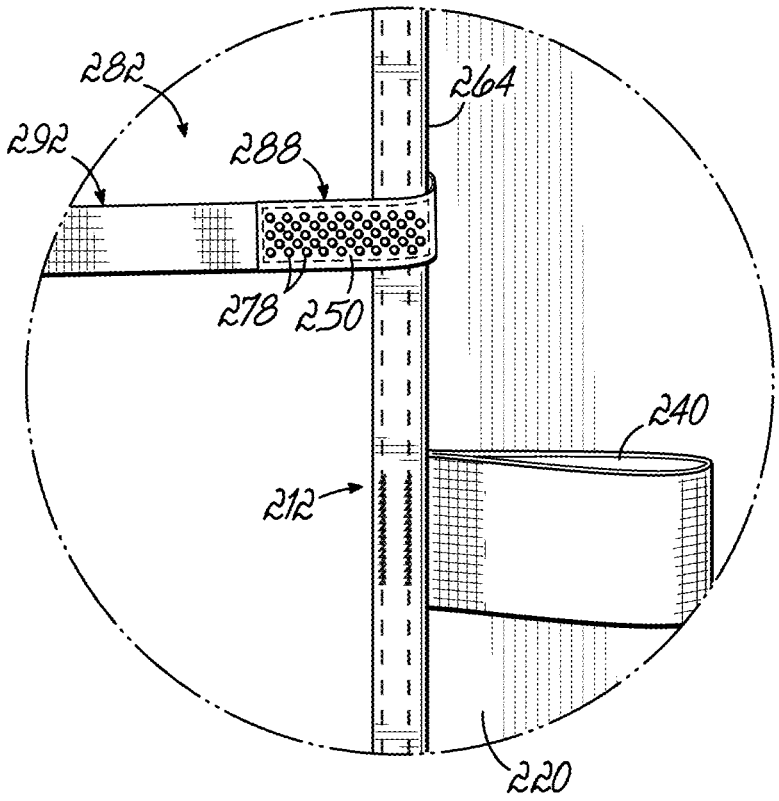
FIG. 14A is a detail plan view of an inside portion of a second elongated tie member of the protective gown of FIG. 14.

Referring now to FIGS. 14 and 14A, the Figures show a further alternative embodiment of the protective gown 10. The protective gown 210 of FIGS. 14 and 14A includes substantially all of the same elements as the surgical gown 10 of FIGS. 1-9B (except for the tie members 90, 92, for example). These elements are provided with similar reference numbers in the 200 series without further explanation below except for the differences in the alternative embodiment of the protective gown 210. For example, the central gown body 212 is analogous to the gown body 12 (shown in FIG. 1, for example), the back panel 216 is analogous to the back panel 16 (shown in FIG. 2, for example), and so on. As shown, the elongated tie members 290, 292 of the protective gown 210 differ from the elongated tie members 90, 92 of the protective gown 10. The tie members 290, 292 of the gown 210 extend substantially straight instead of being folded over like the elongated tie members 90, 92 of the gown 10. Such may be preferred by some wearers of the gown 210.

In the depicted embodiment, the first elongated tie member 290 includes two of the first fasteners 248 (to allow for greater adjustability and to accommodate gown 210 wearers of different sizes). The first of the first fasteners 248 may be located approximately 4 inches from the edge 286 of the overlapping section 222 of the back panel 216. The second of the first fasteners 248 may be located approximately 6 inches from the edge 286. The second elongated tie member 292 includes one of the second fasteners 250. The second fastener 250 may be located proximate or adjacent to a junction 264 of the front panel 214 and the back panel 216. It should be understood that the tie members 290, 292 may include fewer or more fasteners 248, 250 than is expressly shown. For example, the first tie member 290 could include three or more first fasteners 248. FIG. 14 shows that the first fasteners 248 on the first elongated tie member 290 are located on a face of the first elongated tie member 290 that faces towards the gown body 212. FIG. 14A shows that the second fastener 250 on the second elongated tie member 292 is located on a face of the second elongated tie member 292 that faces towards the gown body 212. It should be understood that the fasteners 248, 250 could be alternatively arranged or spaced. For example, one or more of the fasteners 248, 250 could be arranged on an opposing face of the respective tie member 290, 292 (e.g., facing away from the gown body 212). The various fastener and tie configurations from one embodiment described herein can be combined with fasteners and ties from other embodiments without departing from the scope of the present invention.

In yet another alternative embodiment, it should be readily appreciated by those skilled in the art that the gown 10 may be reconfigured in a generally reversed fashion so as to be donned and securely fastened on the right side rather than the left, such as to better accommodate left-handed wearers. That is, the left portion 20 alternatively can include overlapping section 22 and the right portion 18 can include the corresponding overlapped section 24 with the fastening elements 46, the internal waist closure 56, and the external waist closure 82, for example, repositioned accordingly. While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A rear-opening protective gown defining a personal protective equipment garment configured for removal by pull-forward doffing action, the protective gown comprising:

a central gown body sized to wrap around at least a torso area of a wearer, the central gown body including a front panel and a back panel, with the back panel being separated into a right portion and a left portion such that the protective gown opens at the back panel, wherein one of the right portion and left portion includes an overlapping section and the other of the right portion and left portion includes a corresponding overlapped section, the overlapping section and overlapped section being configured to lay over one another when the protective gown is donned by the wearer and closed;

a pair of opposing left and right sleeves that cooperate with and extend away from the central gown body for receiving arms of the wearer;

a neck opening defined by the central gown body adjacent a shoulder region of the central gown body located proximate a junction of the left and right sleeves with the central gown body; and a plurality of fastening elements positioned on or proximate to the back panel, each fastening element including a first fastener mounted on the overlapping section of the back panel and a second fastener mounted on the overlapped section of the back panel of the central gown body, the first and second fasteners configured to engage with one another to define a connection having a shear strength greater than a peel strength thereof, with at least one of the fastening elements being located at the shoulder region, wherein for each of the fastening elements that is located at the shoulder region, one of the first and second fasteners is mounted on a folded tab connected to a corresponding portion of the back panel, the folded tab being pivotable relative to the corresponding portion of the back panel such that when a doffing force is applied to the protective gown, the folded tab rotates to transfer a shearing force to the first and second fasteners, which is generated by transmission of the doffing force through the central gown body, into a peeling force that peels the first fastener apart from the second fastener, thereby facilitating ease of doffing the protective gown by application of the doffing force on the front panel without causing damage to the protective gown, thereby allowing for reuse of the protective gown.

2. The rear-opening protective gown of claim 1, wherein each of the fastening elements is configured to enable the first fastener to releasably engage with the second fastener in various relative positions and orientations such that the connection defined at each fastening element is repositionable and adjustable, while still enabling the transfer from shearing force to peeling force at the fastening elements.

3. The rear-opening protective gown of claim 2, wherein for at least some of the fastening elements, one of the first and second fasteners that is not mounted on a folded tab is formed with an elongated width that is greater than a width of the other of the first and second fasteners, thereby to enable adjustable tightness of closing of the protective gown by engaging the first and second fasteners at different positions and orientations along the elongated width.

4. The rear-opening protective gown of claim 1, wherein each of the first and second fasteners is defined by an array of rigid plastic posts extruded upwardly through a textile backing layer, the rigid plastic posts sized to frictionally insert between one another to form an interlocking posts engagement when the first and second fasteners are engaged with one another.

5. The rear-opening protective gown of claim 4, wherein the array of rigid plastic posts defining the first and second fasteners are configured to be repositionable and frictionally engaged in different positions of the first fastener relative to the second fastener.

6. The rear-opening protective gown of claim 4, wherein the shear strength of the connection formed by the interlocking posts engagement of the first and second fasteners is at least three times greater than the peel strength thereof.

7. The rear-opening protective gown of claim 6, wherein the shear strength of the connection formed by the interlocking posts engagement of the first and second fasteners is greater than 4.5 lbf, and the peel strength of the connection formed by the interlocking posts engagement of the first and second fasteners is less than 1.5 lbf.

8. The rear-opening protective gown of claim 4, wherein each of the fastening elements does not include abrasive materials or sharp edges that can potentially scratch the wearer and/or tear a material of the central gown body during donning and doffing.

9. The rear-opening protective gown of claim 4, wherein the array of rigid plastic posts is configured to engage and disengage without collection of debris or lint during use and without risk of connecting to other gowns and without agglomerating multiple gowns together during laundering thereof.

10. The rear-opening protective gown of claim 1, wherein a rotation of the folded tabs of the fastening elements located at the shoulder region enables a peeling disconnection of the first and second fasteners at 5 lbf or less.

11. The rear-opening protective gown of claim 1, wherein the overlapping section of the back panel includes a terminal edge with a hem where a material defining the back panel is folded over itself and stitched into position, each of the folded tabs, onto which one of the first and second fasteners is mounted, extends from a first tab end secured to a first longitudinal edge of the hem to a second tab end secured to an opposite second longitudinal edge of the hem, and wherein for each of the folded tabs, the first or second fastener extending from a partial portion of the folded tab between the first and second tab ends, such that the folded tab is thereby configured to fold down generally planar to the hem when the first and second fasteners are engaged to hold the protective gown in a closed position at the shoulder region of the protective gown.

12. The rear-opening protective gown of claim 1, wherein the central gown body includes a ventilation cape formed by a ventilation opening along one of the left and right portions of the back panel.

13. The rear-opening protective gown of claim 1, further comprising:

a waist closure including a first closure element connected to and extending outwardly away from an edge of the overlapping section of the back panel and a second closure element mounted adjacent to the overlapped section of the back panel and proximate a junction of the front panel and the back panel, the first closure element carrying one of the first fasteners and the second closure element including one of the second fasteners to collectively define one of the plurality of fastening elements, which when connected, holds the protective gown closed along a waist region of the protective gown.

14. The rear-opening protective gown of claim 13, wherein the first and second fasteners at the waist closure are positioned at a location configured to be easily accessible to a hand such that the first and second fasteners can be disconnected by either pulling apart, or by applying the doffing force to the front panel, which is transmitted through the protective gown to help open both the waist closure and the fastening elements at the shoulder region.

15. The rear-opening protective gown of claim 13, wherein the protective gown further comprises, proximate to the waist closure:

a first elongated tie member extending downwardly from the overlapping section of the back panel; and a second elongated tie member extending downwardly from the overlapped section of the back panel, wherein the first and second elongated tie members are configured to be tied together at the waist region of the wearer to hold the protective gown closed along the waist region as an alternative or in addition to engaging the first and second fasteners at the waist closure.

16. The rear-opening protective gown of claim 13, further comprising:

an internal waist closure including a first closure element connected to a free edge of the overlapped section of the back panel and a second closure element mounted inside an interior of the central gown body proximate the junction of the front panel and the back panel, with the first closure element carrying one of the first fasteners and the second closure element including one of the second fasteners to collectively define another one of the plurality of fastening elements, which when connected, holds the protective gown closed along the waist region of the protective gown, and with one of the first and second closure elements of the internal waist closure being mounted on a folded tab to enable transfer of shearing forces to peeling forces to open the another one at the internal waist closure.

17. The rear-opening protective gown of claim 1, further comprising:

a pair of pull loops connected to the central gown body along opposite sides of a waist region of the wearer and along connections of the front panel to the back panel, wherein the pull loops are sized and positioned to be configured to receive or be configured to be grasped by one or more fingers of hands to thereby provide convenient gripping locations to apply the doffing force to open and remove the protective gown, the convenient gripping locations also being positioned away from portions of the protective gown along the front panel most likely to be soiled during use by the wearer.

18. The rear-opening protective gown of claim 17, wherein each of the pull loops is formed from a twill tape loop stitched into connection with the central gown body.

19. The rear-opening protective gown of claim 17, wherein each of the pull loops is formed from a material having a highly contrasting color from a material defining the central gown body to guide a person to the location where doffing forces should be applied to remove the protective gown.

20. The rear-opening protective gown of claim 1, wherein a material or materials defining the front panel of the central gown body and the left and right sleeves is configured to meet barrier and strength performance metrics defined under ANSI/AAMI PB70:2012 and under ASTM F2407-20, thereby avoiding transmission of microorganisms, bodily fluids, or other contaminants through the protective gown.

21. A rear-opening protective gown defining a personal protective equipment garment configured for removal by pull-forward doffing action, the protective gown comprising:

a central gown body sized to wrap around at least a torso area of a wearer, the central gown body including a front panel and a back panel, with the back panel being separated into a right portion and a left portion such that the protective gown opens at the back panel;

a pair of opposing left and right sleeves that cooperate with and extend away from the central gown body for receiving arms of the wearer;

a neck opening defined by the central gown body adjacent a shoulder region of the central gown body located proximate a junction of the left and right sleeves with the central gown body; and a plurality of fastening elements positioned on or proximate to the back panel, each fastening element including first and second fasteners configured to engage with one another to define a connection having a shear strength greater than a peel strength thereof, wherein for at least some of the fastening elements, one of the first and second fasteners is mounted on a folded tab connected to a corresponding portion of the back panel, the folded tab being pivotable relative to the corresponding portion of the back panel such that when a doffing force is applied to the protective gown, the folded tab rotates to transfer a shearing force, which is generated by transmission of the doffing force through the central gown body, into a peeling force that peels the first fastener apart from the second fastener, and wherein each of the fastening elements is configured to enable the first fastener to releasably engage with the second fastener in various relative positions and orientations such that the connection defined at each fastening element is repositionable and adjustable, while still enabling the transfer from shearing force to peeling force at the fastening elements.

22. The rear-opening protective gown of claim 21, wherein for at least some of the fastening elements, one of the first and second fasteners that is not mounted on a folded tab is formed with an elongated width that is greater than a width of the other of the first and second fasteners, thereby to enable adjustable tightness of closing of the protective gown by engaging the first and second fasteners at different positions and orientations along the elongated width.

23. The rear-opening protective gown of claim 21, wherein each of the first and second fasteners is defined by an array of rigid plastic posts extruded upwardly through a textile backing layer, the rigid plastic posts sized to frictionally insert between one another to form an interlocking posts engagement when the first and second fasteners are engaged with one another.

24. The rear-opening protective gown of claim 21, wherein at least some of the plurality of fastening elements are positioned at the shoulder region, and at least some others of the plurality of fastening elements are positioned at a waist region of the central gown body configured to wrap around a waist of the wearer.

25. The rear-opening protective gown of claim 21, wherein a material defining the front panel of the central gown body and the left and right sleeves is configured to meet barrier and strength performance metrics defined under ANSI/AAMI PB70:2012 and under ASTM F2407-20, thereby avoiding transmission of microorganisms, bodily fluids, or other contaminants through the protective gown.

26. A method of wearing a rear-opening protective gown, comprising:

closing a central gown body of the protective gown so that the central gown body is wrapped around at least a torso area of a wearer, the central gown body including a front panel and a back panel, with the back panel separated into a right portion and a left portion that can lay over one another when the protective gown is closed, the protective gown also including a pair of opposing left and right sleeves and a neck opening;

securing the central gown body in a closed position by connecting first and second fasteners of a plurality of fastening elements positioned on or proximate to the back panel, the first and second fasteners configured to engage with one another to define a connection having a shear strength greater than a peel strength thereof, wherein for at least some of the fastening elements, one of the first and second fasteners is mounted on a folded tab connected to and pivotable relative to the back panel;

doffing the protective gown by pulling the front panel or a waist region of the central gown body to apply a doffing force that transmits to each of the plurality of fastening elements to disconnect the first and second fasteners thereof and thereby allow for opening of the central gown body and removal of the protective gown from a body of the wearer in one single doffing motion, wherein for each of the fastening elements with one of the first and second fasteners mounted on the respective folded tab, the doffing force applied as a shearing force is transferred by rotation of the folded tabs such that the doffing force is instead applied as a peeling force that peels the first fastener apart from the second fastener to allow opening of the at least some fastening elements without causing damage to the protective gown, thereby allowing for reuse of the protective gown.

27. The method of claim 26, further comprising:

disconnecting the first and second fasteners of one of the plurality of fastening elements and reconnecting the first and second fasteners in a different relative position and/or orientation, wherein each of the fastening elements is configured to enable repositionable and adjustable connection of the first and second fasteners, while still enabling the transfer from shearing force to peeling force at the at least some.

28. The method of claim 26, wherein at least some of the plurality of fastening elements are positioned at a shoulder region, and at least some others of the plurality of fastening elements are positioned at a waist region of the central gown body, such that the central gown body is secured and then opened along the shoulder region and along the waist region in the securing and doffing steps.

29. The method of claim 26, wherein the shear strength greater than the peel strength thereof has the peel strength being less than 1.5 lbf such that the doffing force necessary to apply to disconnect the fasteners and open the protective gown during the step of doffing the protective gown can be less than 5 lbf.

30. The method of claim 26, wherein a pair of pull loops is connected to the central gown body along opposite sides of a waist region, and the step of doffing the protective gown further comprises:

pulling forward while grasping the pair of pull loops to apply the doffing force to disconnect the fasteners and remove the protective gown from a body of the wearer, wherein the pull loops allow for the doffing force to be applied without grasping the front panel of the protective gown, said front panel being a portion most likely to be soiled during use by the wearer.

* * * * *